US011810713B2

(12) United States Patent
Shimizu et al.

(10) Patent No.: US 11,810,713 B2
(45) Date of Patent: Nov. 7, 2023

(54) RARE EARTH MAGNET PRECURSOR OR RARE EARTH MAGNET MOLDED BODY HAVING ROUGHENED STRUCTURE ON SURFACE AND METHOD FOR MANUFACTURING SAME

(71) Applicant: Daicel Miraizu Ltd., Tokyo (JP)

(72) Inventors: Kiyoshi Shimizu, Tokyo (JP); Masahiko Itakura, Tokyo (JP); Norihisa Wada, Tokyo (JP); Takayuki Uno, Tokyo (JP)

(73) Assignee: DAICEL MIRAIZU LTD., Tokyo (JP)

( * ) Notice: Subject to any disclaimer, the term of this patent is extended or adjusted under 35 U.S.C. 154(b) by 354 days.

(21) Appl. No.: 17/299,117

(22) PCT Filed: Dec. 24, 2019

(86) PCT No.: PCT/JP2019/050648
§ 371 (c)(1),
(2) Date: Jun. 2, 2021

(87) PCT Pub. No.: WO2020/138094
PCT Pub. Date: Jul. 2, 2020

(65) Prior Publication Data

US 2022/0084746 A1 Mar. 17, 2022

(30) Foreign Application Priority Data

Dec. 25, 2018 (JP) ..... 2018-240930
Jul. 2, 2019 (JP) ..... 2019-123603
Nov. 29, 2019 (JP) ..... 2019-216539

(51) Int. Cl.
*H01F 7/02* (2006.01)
*H01F 1/053* (2006.01)
*H01F 41/02* (2006.01)

(52) U.S. Cl.
CPC ..... *H01F 7/021* (2013.01); *H01F 1/0533* (2013.01); *H01F 41/026* (2013.01)

(58) Field of Classification Search
CPC ..... H01F 41/026; H01F 1/0533; H01F 7/021; H01F 1/0578; H01F 1/113; H01F 7/0221
See application file for complete search history.

(56) References Cited

U.S. PATENT DOCUMENTS 5,074,929 A 12/1991 Bradley et al.
7,378,772 B2 5/2008 Shimizu et al.
(Continued)

FOREIGN PATENT DOCUMENTS

JP 693411 B2 5/1991
JP H08186016 A * 7/1996
(Continued)

OTHER PUBLICATIONS

English Translation of the International Preliminary Report on Patentability, issued in corresponding International Application No. PCT/JP2019/050648 dated Jul. 8, 2021 (13 pages).
(Continued)

*Primary Examiner* — Mohamad A Musleh
(74) *Attorney, Agent, or Firm* — FLYNN THIEL, P.C.

(57) ABSTRACT

Provided are a rare earth magnet precursor having a roughened structure on a surface or a rare earth magnet molded body having a roughened structure on a surface, and a method for manufacturing the same. In the rare earth magnet precursor or the rare earth magnet molded body, recesses and protrusions are formed on the surface having the roughened structure, and the recesses and protrusions satisfy at least one of the following (a) to (c): (a) an arithmetic mean height (Sa) (ISO 25178) from 5 to 300 μm, (b) a maximum
(Continued)

height (Sz) (ISO 25178) from 50 to 1500 μm, and (c) a developed interfacial area ratio (Sdr) (ISO 25178) from 0.3 to 12.

20 Claims, 21 Drawing Sheets

(56) References Cited

U.S. PATENT DOCUMENTS

| | | | |
|---|---|---|---|
| 9,754,719 | B2 | 9/2017 | Ohshima et al. |
| 2016/0001512 | A1 | 1/2016 | Sakaguchi |
| 2019/0228888 | A1 | 7/2019 | Fujikawa et al. |

FOREIGN PATENT DOCUMENTS

| | | | | | |
|---|---|---|---|---|---|
| JP | 2000124019 | A | * | 4/2000 | ..... H01F 41/026 |
| JP | 2001230108 | A | | 8/2001 | |
| JP | 2005152960 | A | | 6/2005 | |
| JP | 2008251675 | A | | 10/2008 | |
| JP | 5848104 | B2 | | 6/2013 | |
| JP | 5788836 | B2 | | 2/2014 | |
| JP | 5798534 | B2 | | 3/2014 | |
| JP | 5798535 | B2 | | 3/2014 | |
| JP | 5889775 | B2 | | 4/2014 | |
| JP | 2014138511 | A | | 7/2014 | |
| JP | 5932700 | B2 | | 10/2014 | |
| JP | 2015220974 | A | | 12/2015 | |
| JP | 6055529 | B2 | | 4/2016 | |
| JP | 2016-107609 | A | | 6/2016 | |
| JP | 2016203643 | A | | 12/2016 | |
| JP | 6079887 | B2 | | 2/2017 | |
| TW | 201826292 | A | | 7/2018 | |
| WO | 2004068673 | A2 | | 8/2004 | |
| WO | 2011048652 | A1 | | 4/2011 | |
| WO | 2014132743 | A1 | | 9/2014 | |

OTHER PUBLICATIONS

Search Report issued in corresponding European Application No. 19904388.6, dated Nov. 14, 2022 (9 pages).
Japanese Office Action issued in corresponding Japanese Application No. 2020-563314 dated Oct. 26, 2021 (4 pages).
Office Action issued in corresponding Chinese Application No. 201980084981.3, dated Oct. 24, 2022 (9 pages).
Taiwan Office Action issued in corresponding Taiwan Application No. 108147499 dated Aug. 14, 2023 (5 pages).

* cited by examiner (a)

(b)

(c)

(a)

(b)

(c)

(a)

(b)

(c)

(a)

(b)

(c)

(a)

(b)

(c)

(a)

(b)

(c)

(a)

(b)

(c)

(a)

(b)

(a)

(b)

(a)

(b)

RARE EARTH MAGNET PRECURSOR OR RARE EARTH MAGNET MOLDED BODY HAVING ROUGHENED STRUCTURE ON SURFACE AND METHOD FOR MANUFACTURING SAME

TECHNICAL FIELD

In several aspects, the present disclosure relates to a rare earth magnet precursor having a roughened structure on a surface or a rare earth magnet molded body having a roughened structure on a surface, and a method of manufacturing such a rare earth magnet precursor or rare earth magnet molded body. In several other aspects, the present disclosure also relates to a composite molded body containing such a rare earth magnet precursor or rare earth magnet molded body, and a method of manufacturing a composite molded body.

BACKGROUND ART

Permanent magnets are used in a variety of technical fields. JP 6-93411 B describes an invention in which, when a permanent magnet is used in a position sensor, a permanent magnet made from an iron-based alloy with a high coercive force is formed, the surface layer thereof is rapidly melted by a high-energy beam and then cooled to thereby disrupt the coercive force, and a thin surface layer having a low coercive force and high magnetic permeability is formed. It is described that a $CO_2$ laser with a beam output density of $1.26\times10^4$ W/cm$^2$ is used as the high-energy beam when an 8 mm thick magnet is treated.

WO 2004/068673 A1 describes an invention of a rotor for a permanent magnet motor in which a permanent magnet is bonded to a rotor yoke surface by interposing a metal film between the permanent magnet and the rotor yoke and implementing beam welding. Laser beam welding is used as the beam welding (in Example 1, etc.).

JP 6079887 B describes an invention of a cutting method for cutting a permanent magnet to manufacture a magnet piece that configures a magnet body for a field pole used in a rotary electric machine, and indicates that laser beam irradiation is used as a method of forming a brittle section to be cut.

SUMMARY OF INVENTION

Technical Problem

In several aspects, an object of the present disclosure is to provide a rare earth magnet precursor having a roughened structure on a surface or a rare earth magnet molded body having a roughened structure on a surface. In several other aspects, an object of the present disclosure is to provide a method of manufacturing such a rare earth magnet precursor or rare earth magnet molded body.

Solution to Problem

The present disclosure provides, in one example, a rare earth magnet precursor or a rare earth magnet molded body, having a roughened structure on a surface, wherein recesses and protrusions satisfying at least one of the following requirements (a) to (c) are formed on the surface having the roughened structure.

(a) An arithmetic mean height (Sa) (ISO 25178) from 5 to 300 μm, (b) a maximum height (Sz) (ISO 25178) from 50 to 1500 μm, and (c) a developed interfacial area ratio (Sdr) (ISO 25178) from 0.3 to 12.

The present disclosure also provides, in another example, a rare earth magnet precursor or a rare earth magnet molded body, having a roughened structure on a surface, wherein the surface having the roughened structure includes a plurality of independent protrusions each surrounded by a recess, or includes a plurality of independent recesses and a protrusion surrounding each recess, and recesses and protrusions satisfying at least one of the following requirements (a') to (c') are formed.

(a') An arithmetic mean height (Sa) (ISO 25178) from 5 to 150 μm, (b') a maximum height (Sz) (ISO 25178) from 50 to 700 μm, and (c') a developed interfacial area ratio (Sdr) (ISO 25178) from 0.3 to 6.

Advantageous Effects of Invention

Rare earth magnet precursors or rare earth magnet molded bodies according to several examples of the present disclosure have a roughened structure on the surface and can be used as manufacturing intermediates for manufacturing a composite molded body with other materials. Accordingly, several other aspects of the present disclosure also provide a composite molded body that includes such a rare earth magnet precursor or a rare earth magnet molded body, and a method for manufacturing the composite molded body.

According to the manufacturing method based on several examples of the present disclosure, the surface of the rare earth magnet precursor or rare earth magnet molded body can be roughened without causing deformation such as cracking.

BRIEF DESCRIPTION OF DRAWINGS

FIG. 2(*a*) is an irradiation pattern of irradiation in the same direction, and FIG. 2(*b*) is an irradiation pattern of irradiation in both directions.

FIG. 16(*b*) is an SEM image of a cross section in a thickness direction orthogonal to the direction of formation of linear protrusions and linear recesses in FIG. 16(*a*), and FIG. 16(*c*) is an SEM image for explaining the relationship between the non-roughened structure surface and the roughened structure surface in FIG. 16(*b*).

DESCRIPTION OF EMBODIMENTS

Figure 1:
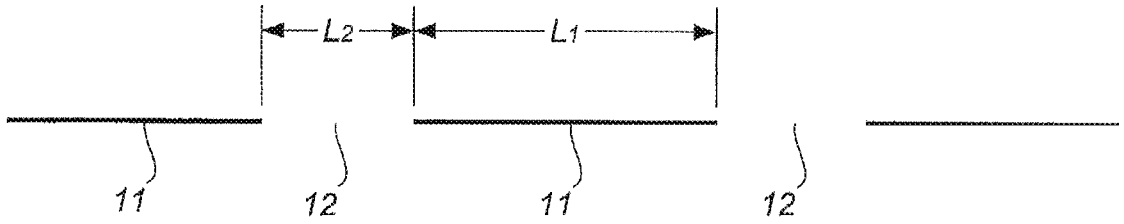
FIG. 1 is a diagram illustrating an irradiation state of a laser beam according to an embodiment of one example of the present disclosure when a second usage method of continuous-wave laser beam is implemented.

<Rare Earth Magnet Precursor or Rare Earth Magnet Molded Body Having Roughened Structure on Surface>

In several examples of the present disclosure, a rare earth magnet precursor may be an unmagnetized rare earth magnet having a roughened structure on a surface. That is, in the present disclosure, a rare earth magnet precursor may refer to an unmagnetized rare earth magnet material. Here, the term "unmagnetized" means that the material is not magnetized as a magnet, and may include a material that has been demagnetized after being magnetized once. Also, in the present disclosure, a rare earth magnet may refer to a magnetized rare earth magnet material. In one example of the present disclosure, a rare earth magnet molded body may be a magnetized rare earth magnet material having a roughened structure on a surface.

In several examples of the present disclosure, rare earth magnet molded bodies having a roughened structure on a surface may include a rare earth magnet molded body obtained by magnetizing a rare earth magnet precursor having a roughened structure, as well as a rare earth magnet molded body obtained by forming a roughened structure on a raw molded body of a magnetized rare earth magnet molded body.

In several examples of the present disclosure, the shape and size of the rare earth magnet precursor or the rare earth magnet molded body are not particularly limited, and can be adjusted, as appropriate, according to the application. For example, as the rare earth magnet precursor or rare earth magnet molded body, a molded body such as a flat plate, a round rod, a square rod (a rod having a polygonal cross section), a tube, a cup-shaped object, a cube, a cuboid, a sphere or partial sphere (such as a hemisphere), an ellipsoid or partial ellipsoid (such as a semi-ellipsoid), and an irregularly shaped molded body, and an existing product of a rare earth magnet molded body (magnetized rare earth magnet molded body) can be used.

Examples of the existing product of a rare earth magnet molded body include those consisting only of a rare earth magnet molded body, as well as those containing a composite of a pre-produced rare earth magnet molded body and another material (such as metal, resin, rubber, glass, or wood).

In several examples of the present disclosure, in order to prevent cracking when the roughened structure is formed, the rare earth magnet precursor or rare earth magnet molded body has, in a preferable aspect of the present disclosure, a rupture strength of 80 MPa or greater in the raw molded body before the roughened structure is formed, and in another preferable aspect of the present disclosure, the rupture strength is 100 MPa or greater.

In several examples of the present disclosure, in order to prevent cracking when the roughened structure is formed, the raw molded body of the rare earth magnet precursor or the raw molded body of the rare earth magnet molded body has, in a preferable aspect of the present disclosure, a thickness of a portion with the roughened structure formed of 0.5 mm or greater, and in another preferable aspect of the present disclosure, the thickness thereof is 1 mm or greater.

In several examples of the present disclosure, the rare earth magnet precursor or rare earth magnet molded body is selected from samarium cobalt, neodymium, praseodymium, alnico, and strontium-ferrite in a preferable aspect of the present disclosure.

In several examples of the present disclosure, the "length direction" in a first embodiment and a second embodiment of the rare earth magnet precursor or rare earth magnet molded body may be a direction connecting from one point on the surface of the rare earth magnet precursor or on the surface of the rare earth magnet molded body to another point spaced apart from the one point, regardless of the planar shape of the rare earth magnet precursor or rare earth magnet molded body.

In several examples of the present disclosure, the shape (planar shape and cross-sectional shape in the thickness direction) of the recesses and protrusions of the roughened structure of the rare earth magnet precursor or rare earth magnet molded body is not particularly limited, and may be different according to the machining method for forming the roughened structure.

In the first embodiment of the rare earth magnet precursor or the rare earth magnet molded body of the present disclosure, the surface of the rare earth magnet precursor or the rare earth magnet molded body with the roughened structure formed has recesses and protrusions, and may satisfy at least one of the requirements (a) to (c) below, In the first embodiment of a rare earth magnet precursor or rare earth magnet molded body of the present disclosure, in a preferred aspect of the present disclosure, two of the following requirements, namely, requirements (a) and (b), requirements (b) and (c), or requirements (a) and (c) may be satisfied, and in another preferred aspect of the present disclosure, all of the requirements (a), (b), and (c) may be satisfied.

Requirement (a): arithmetic mean height (Sa) (ISO 25178) of protrusions and recesses on the surface of the roughened structure portion may be from 5 to 300 μm, may be from 5 to 200 μm in a preferred aspect of the present disclosure, and may be from 10 to 150 μm in another preferred aspect of the present disclosure.

Requirement (b): maximum height (Sz) (ISO 25178), which is the difference in height between the protrusions and recesses of the recesses and protrusions on the surface of the roughened structure portion, may be from 50 to 1500 μm, may be from 150 to 1300 μm in a preferred aspect of the present disclosure, and may be from 200 to 1200 μm in another preferred aspect of the present disclosure.

Requirement (c): developed interfacial area ratio (Sdr) (ISO 25178) may be from 0.3 to 12, may be from 0.3 to 10 in a preferred aspect of the present disclosure, and may be from 0.3 to 8 in another preferred aspect of the present disclosure.

In the first embodiment of the rare earth magnet precursor or rare earth magnet molded body of the present disclosure, in addition to the requirements (a) to (c), the rare earth magnet precursor or rare earth magnet molded body may further satisfy a requirement (d) in which a root mean square gradient (Sdq) (ISO 25178) is within a predetermined value range.

Requirement (d): root mean square gradient (Sdq) may be from 0.3 to 8 in a preferred aspect of the present disclosure, may be from 0.5 to 5 in another preferred aspect of the present disclosure, and may be from 0.7 to 3 in yet another preferred aspect of the present disclosure.

The first embodiment of the rare earth magnet precursor or the rare earth magnet molded body of the present disclosure satisfies at least one of the above-mentioned requirements (a) to (c) in a preferred aspect of the present disclosure, and may have a roughened structure (roughened structure of an embodiment 1a) like that indicated below.

Figure 3:
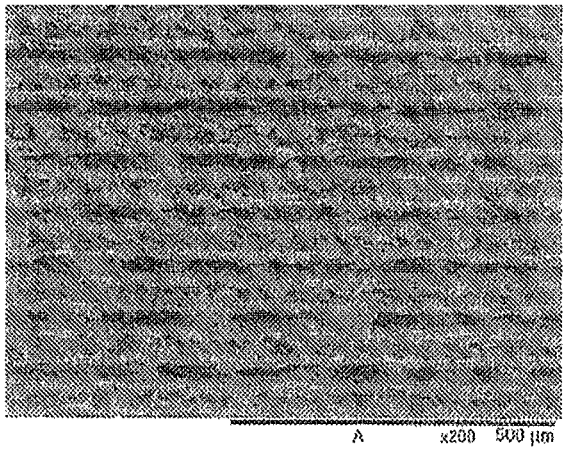
FIG. 3(*a*) is an SEM image of a surface of a rare earth magnet molded body having a roughened structure and obtained in Example 1, FIG. 3(*b*) is an SEM image of a cross-section in the thickness direction of FIG. 3(*a*), and FIG. 3(*c*) is an SEM image for explaining the relationship between a non-roughened structure surface and a roughened structure surface in FIG. 3(*b*).
Figure 3:
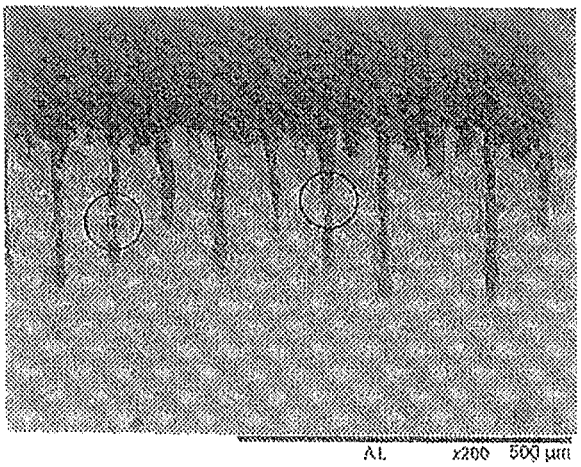
Figure 3:
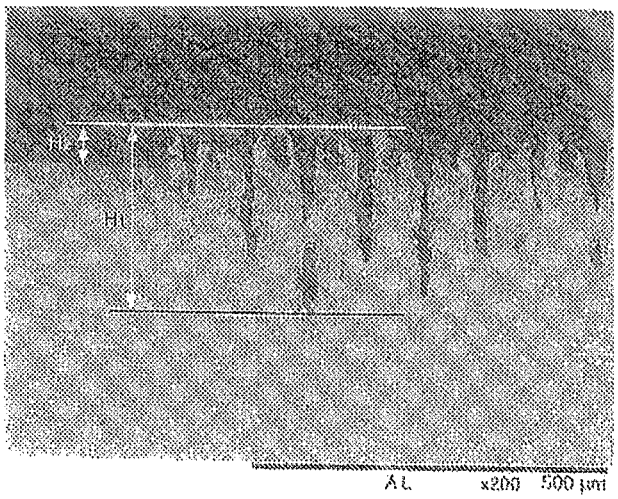
Figure 7:
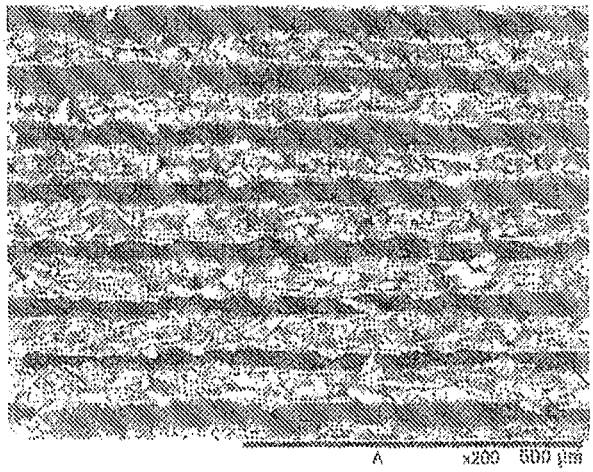
FIG. 7(*a*) is an SEM image of a surface of a rare earth magnet molded body having a roughened structure and obtained in Example 5, FIG. 7(*b*) is an SEM image of a cross-section in the thickness direction of FIG. 7(*a*), and FIG. 7(*c*) is an SEM image for explaining the relationship between a non-roughened structure surface and a roughened structure surface in FIG. 7(*b*).
Figure 7:
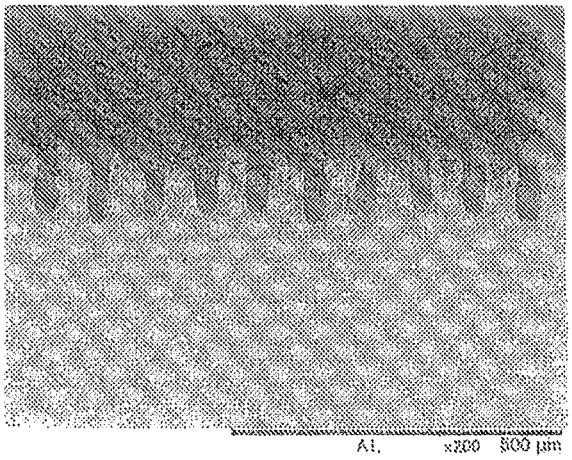
Figure 7:
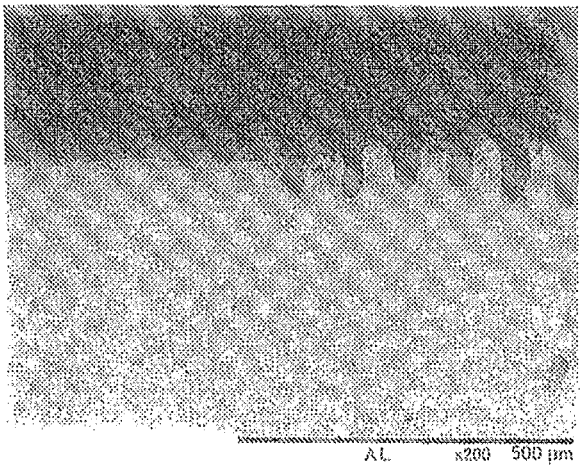
Figure 9:
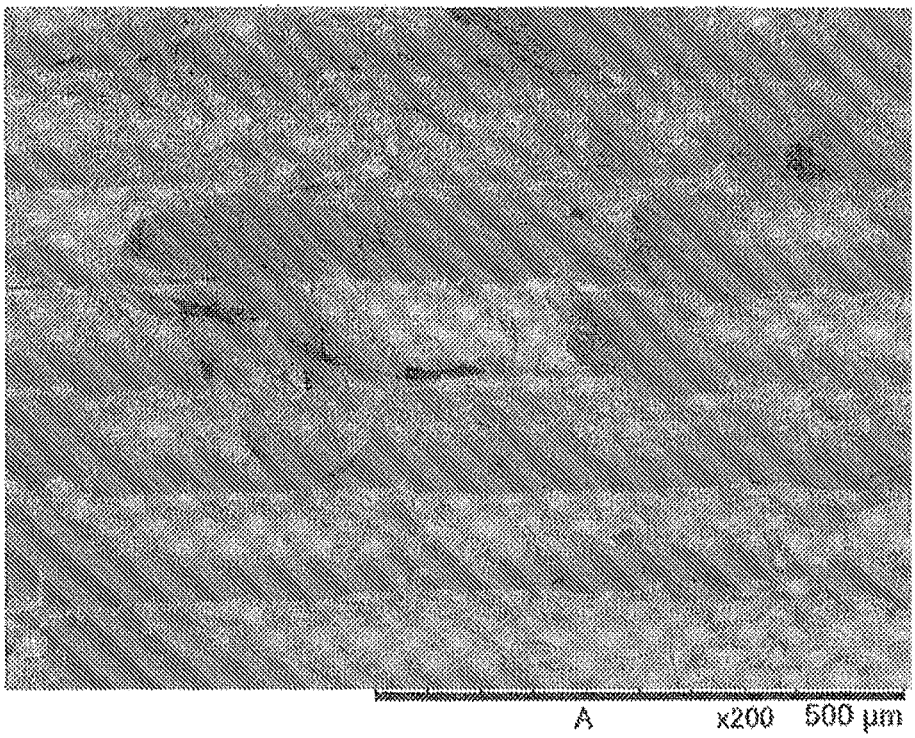
FIG. 9 is an SEM image of a rare earth magnet molded body having a roughened structure and obtained in Example 7.

The roughened structure of the embodiment 1a includes linear protrusions formed along the length direction and linear recesses formed along the length direction, and the linear protrusions and the linear recesses are alternately formed in a direction orthogonal to the length direction (FIGS. 3, 7, and 9). Both the linear protrusions and the linear recesses can be shaped as straight lines or curved lines, or can be a straight line shape partially including a curved line portion, or a curved line shape partially including a straight line portion. The linear protrusions may have numerous pores and numerous small protrusions on the surface.

Figure 12:
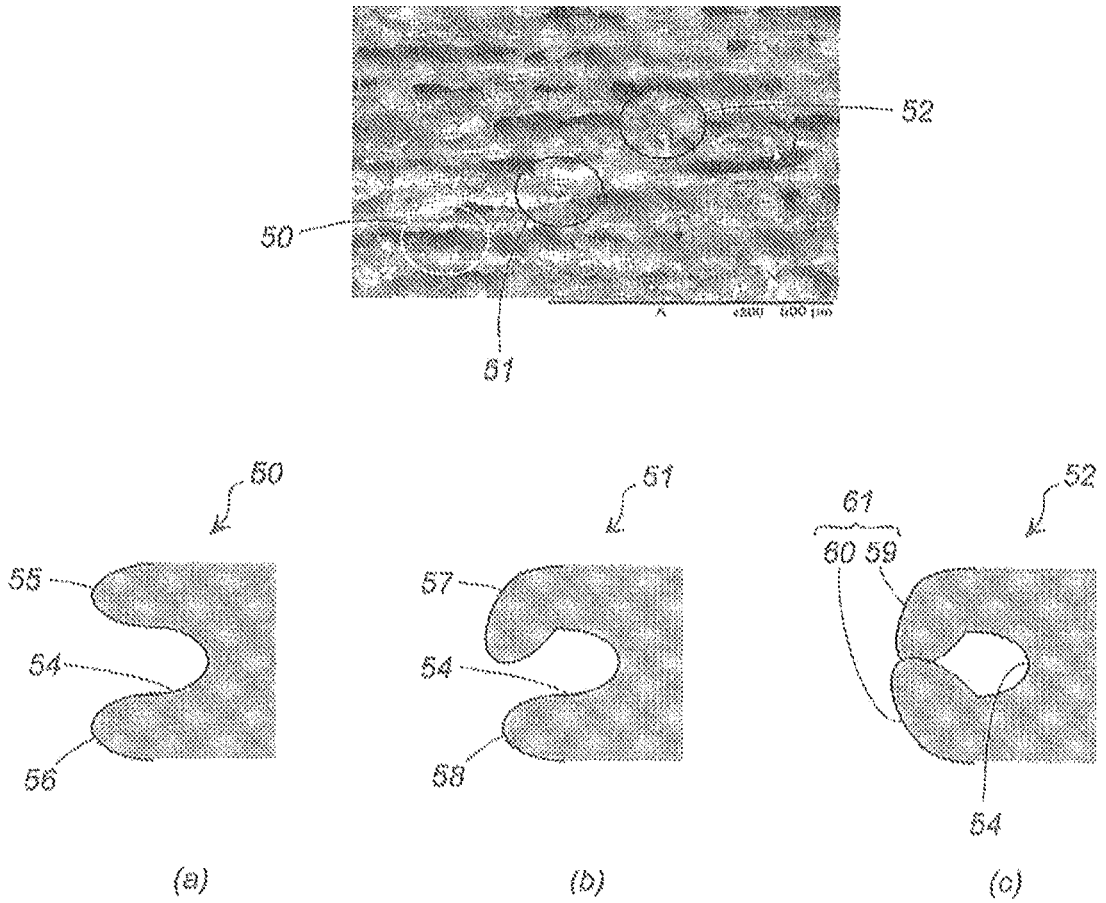
FIG. 12 includes the SEM image of FIG. 4, and schematic cross-sectional views (a) to (c) for explaining three different cross-sectional structures in the roughened structure of the SEM image.

The roughened structure of the embodiment 1a may include a portion in which one or both linear protrusions adjacent in a direction orthogonal to the length direction are deformed in a hook shape and thus are mutually approaching (but are not mutually contacting) (FIG. 12(*b*)), or a portion that includes an outer bridge portion in which linear protrusions that are adjacent in a direction orthogonal to the length direction are crosslinked with each other (FIG. 12(*c*)).

In the roughened structure of the embodiment 1a, a pitch p1 (distance between center positions in the width direction of adjacent linear recesses [or adjacent linear protrusions]) between adjacent linear recesses (or adjacent linear protrusions), and a width w1 of the linear recess (or linear protrusion) may satisfy a relationship of $w1 \leq p1 \times (0.1 \text{ to } 0.9)$ in a preferred aspect of the present disclosure, and may satisfy a relationship of $w1 \leq p1 \times (0.3 \text{ to } 0.7)$ in another preferred aspect of the present disclosure.

The first embodiment of the rare earth magnet precursor or the rare earth magnet molded body of the present disclosure satisfies at least one of the above-mentioned requirements (a) to (c) in preferred aspect of the present disclosure, and may have a roughened structure (roughened structure of an embodiment 1b) like that indicated below.

Figure 4:
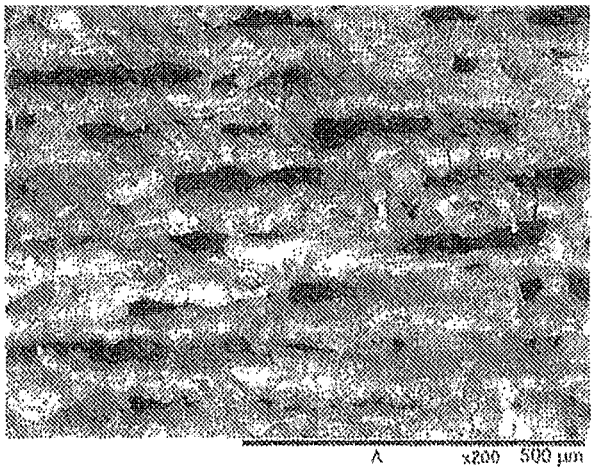
FIG. 4(*a*) is an SEM image of a surface of a rare earth magnet molded body having a roughened structure and obtained in Example 2, FIG. 4(*b*) is an SEM image of a cross-section in the thickness direction of FIG. 4(*a*), and FIG. 4(*c*) is an SEM image for explaining the relationship between a non-roughened structure surface and a roughened structure surface in FIG. 4(*b*).
Figure 4:
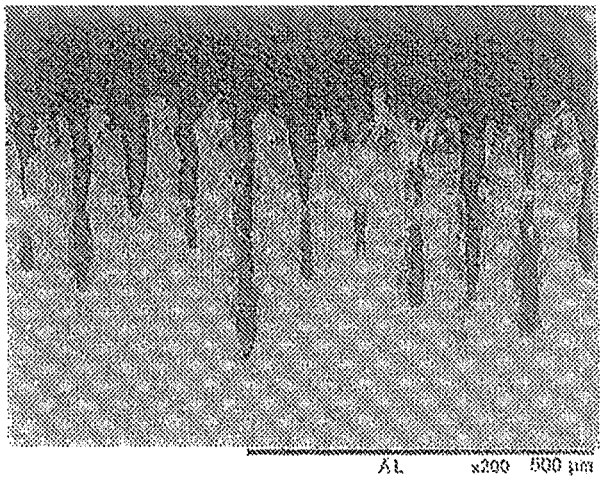
Figure 4:
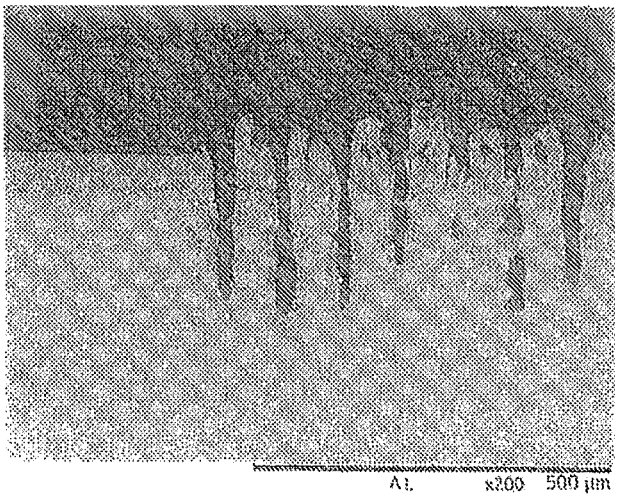
Figure 8:
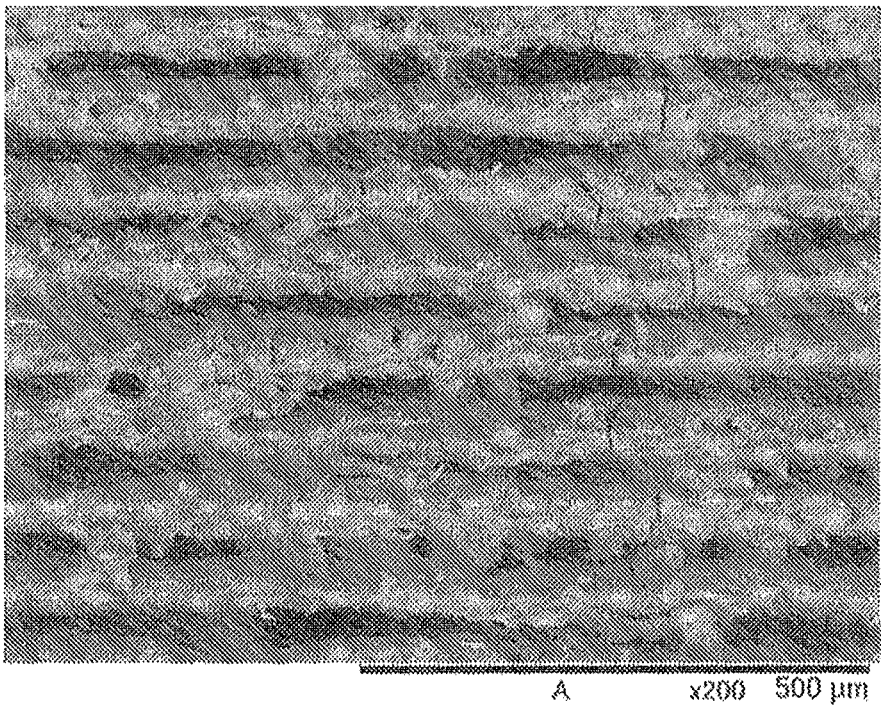
FIG. 8 is an SEM image of a rare earth magnet molded body having a roughened structure and obtained in Example 6.

The roughened structure of the embodiment 1b is formed by intermingling a plurality of recess regions and a plurality of protrusion regions in the length direction, and a plurality of rows of the plurality of recess regions and plurality of protrusion regions intermingled and formed in the length direction are formed in a direction orthogonal to the length direction (FIG. 4 and FIG. 8). A portion that is not a recess region is a protrusion region.

Figure 5:
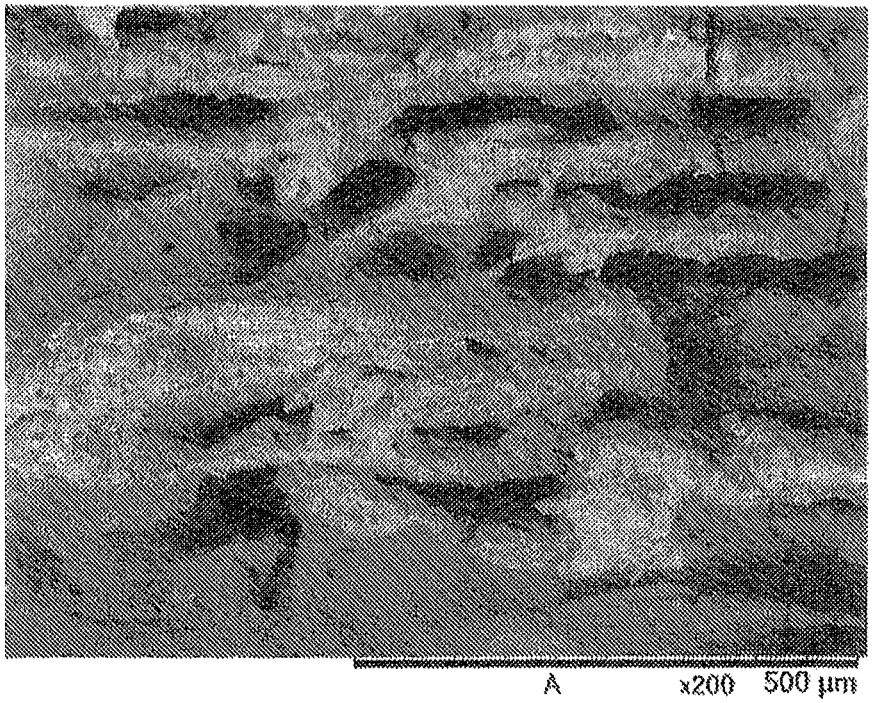
FIG. 5 is an SEM image of a rare earth magnet molded body having a roughened structure and obtained in Example 3.
Figure 6:
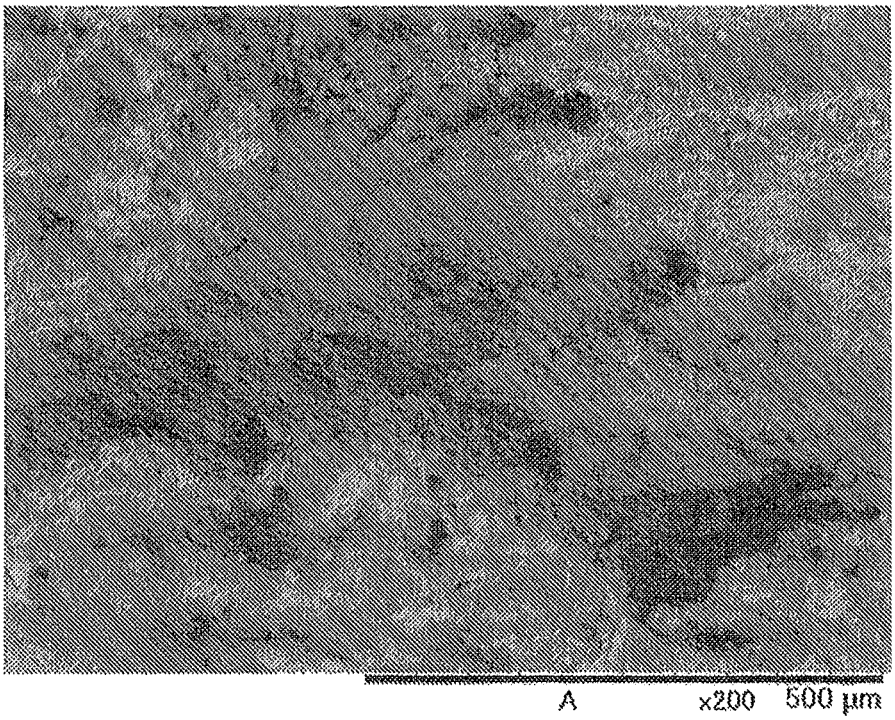
FIG. 6 is an SEM image of a rare earth magnet molded body having a roughened structure and obtained in Example 4.

The roughened structure of the embodiment 1b may include a portion in which one or both protrusions of protrusion regions adjacent in a direction orthogonal to the length direction are deformed in a hook shape and thus are mutually approaching (but are not mutually contacting) (FIG. 12(*b*)), or a portion that includes an outer bridge portion in which protrusions of protrusion regions that are adjacent in a direction orthogonal to the length direction are crosslinked with each other (FIG. 12(*c*)). In addition, an embodiment in which large protrusions and large recesses are intermingled by fusing the protrusions formed in the length direction, or fusing the recesses formed in the length direction may also be included (FIG. 5 and FIG. 6).

The first embodiment of the rare earth magnet precursor or rare earth magnet molded body of the present disclosure satisfies at least one of the above-mentioned requirements (a) to (c) in a preferred aspect of the present disclosure, and in some cases, further satisfies the requirement (d), and may have a roughened structure (roughened structure, of an embodiment 1c) (refer to FIG. 25) like that indicated below.

Figure 24:
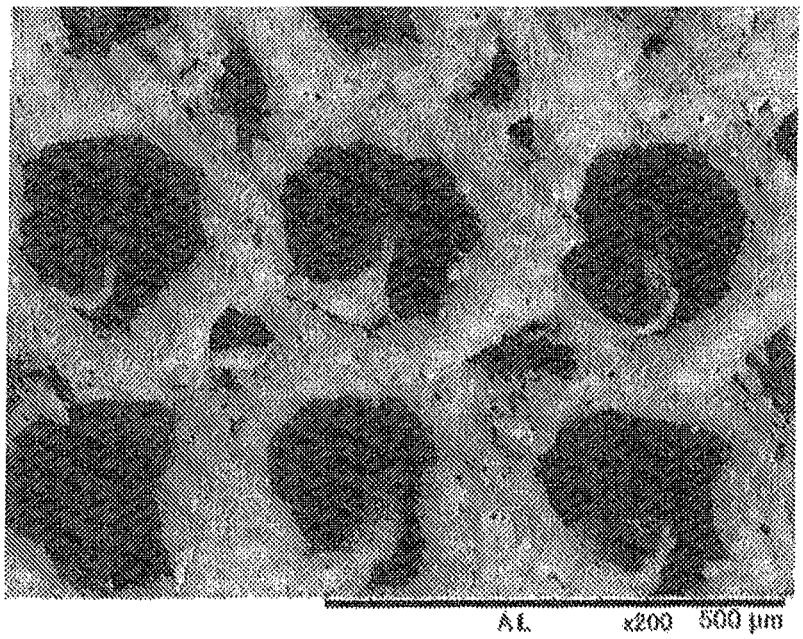
FIG. 24(*a*) is an SEM image of a surface of a rare earth magnet molded body having a roughened structure and obtained in Example 16, and FIG. 24(*b*) is a cross-sectional view in the thickness direction of FIG. 24(*a*).
Figure 24:
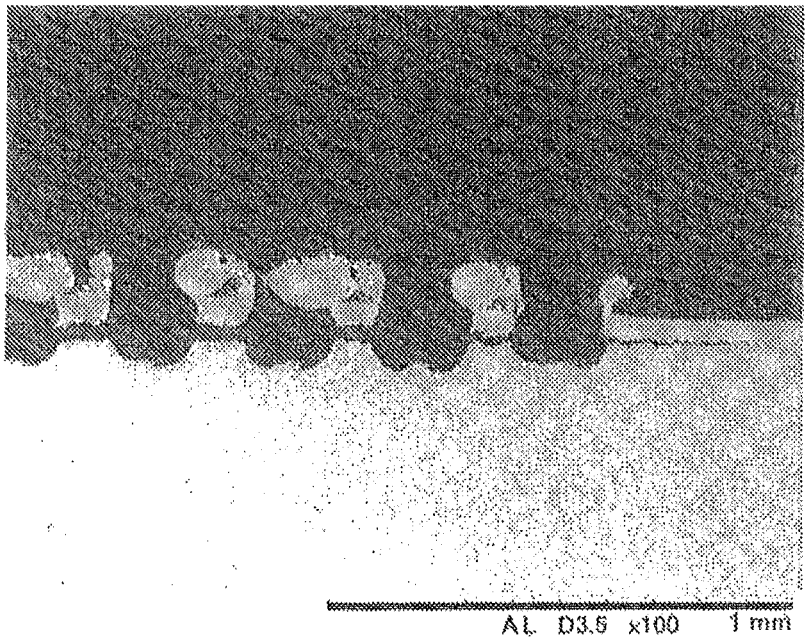

The roughened structure of the embodiment 1c includes a plurality of circular recesses and an annular protrusion formed around each of the plurality of circular recesses, and further includes recesses surrounded by a plurality of adjacent annular protrusions. The recesses surrounded by the plurality of adjacent annular protrusions are in a form in which, for example, when four annular protrusions are in contact, the portion surrounded by these protrusions is a recess (see FIG. 24(*a*)). FIG. 24(*a*) illustrates a form in which four annular protrusions are in contact, but other forms include a form in which three annular protrusions are in contact, and a form in which five or more annular protrusions are in contact. The adjacent annular protrusions may be integrated, and all or some of the annular protrusions may have a hook-shaped projecting part projected into the inner circular recess.

The first embodiment of the rare earth magnet precursor or rare earth magnet molded body of the present disclosure satisfies at least one of the above-mentioned requirements (a) to (c) in a preferred aspect of the present disclosure, and in some cases, further satisfies the requirement (d), and may have a roughened structure (roughened structure of an embodiment 1d) (refer to FIG. 25) like that indicated below.

Figure 25:
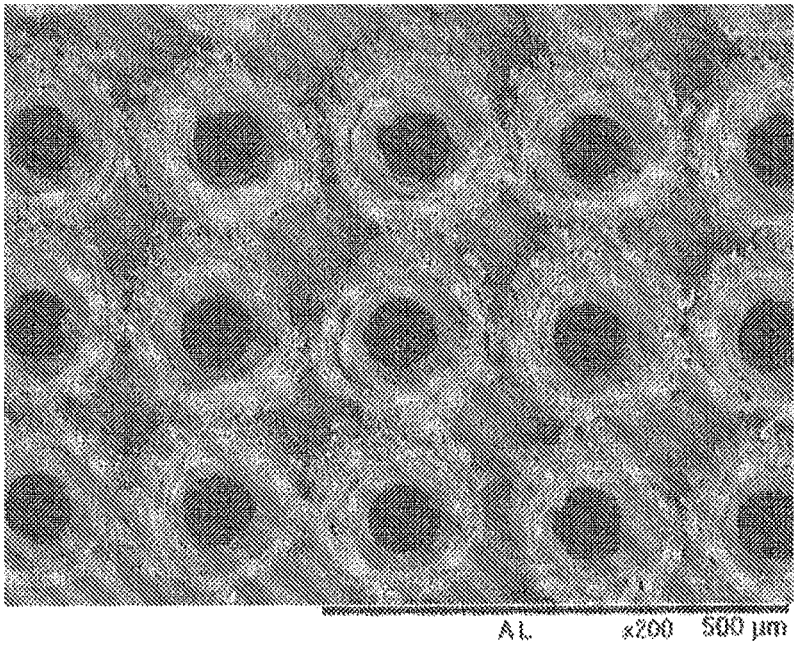
FIG. 25 is an SEM image of a surface of a rare earth magnet molded body having a roughened structure and obtained in Example 17.

The roughened structure of the embodiment 1d includes a plurality of circular recesses and an annular protrusion formed around each of the plurality of circular recesses, and further includes recesses surrounded by a plurality of adjacent annular protrusions. The recesses surrounded by the plurality of adjacent annular protrusions are in a form in which, for example, when four annular protrusions are in contact, the portion surrounded by these protrusions is a recess (see FIG. 25). FIG. 25 illustrates a form in which four annular protrusions are in contact, but other forms include a form in which three annular protrusions are in contact, and a form in which five or more annular protrusions are in contact. Adjacent annular protrusions may be independent, but may also have numerous projections projected outward from an outer circumferential wall section, with the projections of adjacent annular protrusions being in mutual contact, and the annular protrusions may be such that the projections of adjacent annular protrusions are mutually connected.

In a preferred aspect of the present disclosure, the embodiments 1a to 1d of the rare earth magnet precursor or the rare earth magnet molded body of the present disclosure may have a roughened structure (roughened structure of an embodiment 1e) like that indicated below.

The roughened structure of the embodiment 1e has, when a surface on which the roughened structure is not formed is used as a reference surface, a cross-sectional shape in the thickness direction including an intermingling of a portion that bulges further upward than the reference surface and a portion in which a groove deeper than the reference surface is formed. A ratio (H2/H1) of a height (H2 in FIG. 3(*c*)) from the reference surface to a highest leading end of the bulging portion, to a distance (H1 in FIG. 3(*c*)) from the highest leading end of the bulging portion to a deepest bottom surface section of the groove may be in a range from 0.1 to 0.7 in a preferred aspect of the present disclosure, and may be in a range from 0.2 to 0.6 in another preferred aspect of the present disclosure.

Furthermore, in a preferred aspect of the present disclosure, the roughened structure of the embodiment 1e is such that at least some of the bulging portions include at least one of a portion at which a part of the leading end is deformed in a hook shape, or a portion at which a part of the leading end is deformed in a ring shape. Furthermore, in a preferred aspect of the present disclosure, the roughened structure of the embodiment 1e is such that at least some of the grooves have an inner bridge portion in which opposing inner wall surfaces of the groove are connected.

In a preferred aspect of the present disclosure, the embodiments 1a to 1d of the rare earth magnet precursor or rare earth magnet molded body of the present disclosure may have a roughened structure (roughened structure of an embodiment 1f) like that indicated below.

The roughened structure of the embodiment 1f has, when a surface on which the roughened structure is not formed is used as a reference surface, a cross-sectional shape in the thickness direction including an intermingling of a portion that bulges further upward than the reference surface and a portion in which a groove deeper than the reference surface is formed. A ratio (H2/H1) of a height (H2 in FIG. 3(*c*)) from the reference surface to a highest leading end of the bulging portion to a distance (H1 in FIG. 3(*c*)) from the highest leading end of the bulging portion to a deepest bottom surface section of the groove may be in a range from 0.1 to 0.7 in a preferred aspect of the present disclosure, and may be in a range from 0.2 to 0.6 in another preferred aspect of the present disclosure.

Furthermore, in a preferred aspect of the present disclosure, the roughened structure of the embodiment 1f is such that at least some of the bulging portions include a portion at which a part of the leading end is deformed in a hook shape. Furthermore, in a preferred aspect of the present disclosure, the roughened structure of the embodiment 1f may be such that a cross-sectional shape of a bottom surface of the groove has a curved surface.

In the second embodiment of the rare earth magnet precursor or rare earth magnet molded body of the present disclosure, the surface on which the roughened structure is formed has a plurality of independent protrusions surrounded by a recess, or has a plurality of independent recesses and a protrusion surrounding each recess, and the recesses and protrusions satisfy at least one of the following requirements of (a') to (c').

In the second embodiment of the rare earth magnet precursor or rare earth magnet molded body of the present disclosure, in a preferred aspect of the present disclosure, two of the following requirements, namely, requirements (a') and (b'), requirements (b') and (c'), or requirements (a') and (c') may be satisfied, and in another preferred aspect of the present disclosure, all of the requirements (a'), (b'), and (c') may be satisfied.

Requirement (a'): arithmetic mean height (Sa) (ISO 25178) of recesses and protrusions on the surface of the roughened structure portion may be from 5 to 150 μm, may be from 5 to 100 μm in a preferred aspect of the present disclosure, and may be from 10 to 50 μm in another preferred aspect of the present disclosure.

Requirement (b'): maximum height (Sz) (ISO 25178), which is the difference in height between the protrusions and recesses of the recesses and protrusions on the surface of the roughened structure portion, may be from 50 to 700 μm, may be from 100 to 600 μm in a preferred aspect of the present disclosure, and may be from 120 to 500 μm in another preferred aspect of the present disclosure.

Requirement (c'): developed interfacial area ratio (Sdr) (ISO 25178) may be from 0.3 to 6, may be from 0.3 to 5 in a preferred aspect of the present disclosure, may be from 0.3 to 4 in another preferred aspect of the present disclosure, and may be from 0.35 to 3 in yet another preferred aspect of the present disclosure.

In the second embodiment of the rare earth magnet precursor or rare earth magnet molded body of the present disclosure, in addition to the requirements (a') to (c'), the rare earth magnet precursor or rare earth magnet molded body may further satisfy a requirement (d) in which a root mean square gradient (Sdq) is within a predetermined value range.

Requirement (d): root mean square gradient (Sdq) may be from 0.3 to 8 in a preferred aspect of the present disclosure, may be from 0.5 to 5 in another preferred aspect of the present disclosure, and may be from 0.7 to 3 in yet another preferred aspect of the present disclosure.

The second embodiment of the rare earth magnet precursor or rare earth magnet molded body of the present disclosure satisfies at least one of the above-mentioned requirements (a') to (c') in a preferred aspect of the present disclosure, and in some cases, further satisfies the requirement (d), and may have a roughened structure like that indicated below.

The roughened structure of the second embodiment may be one in which the surface on which the roughened structure is formed has a plurality of independent protrusions surrounded by recesses (embodiment 2a), or may have a plurality of independent recesses and a protrusion surrounding each recess (embodiment 2b).

Figure 10:
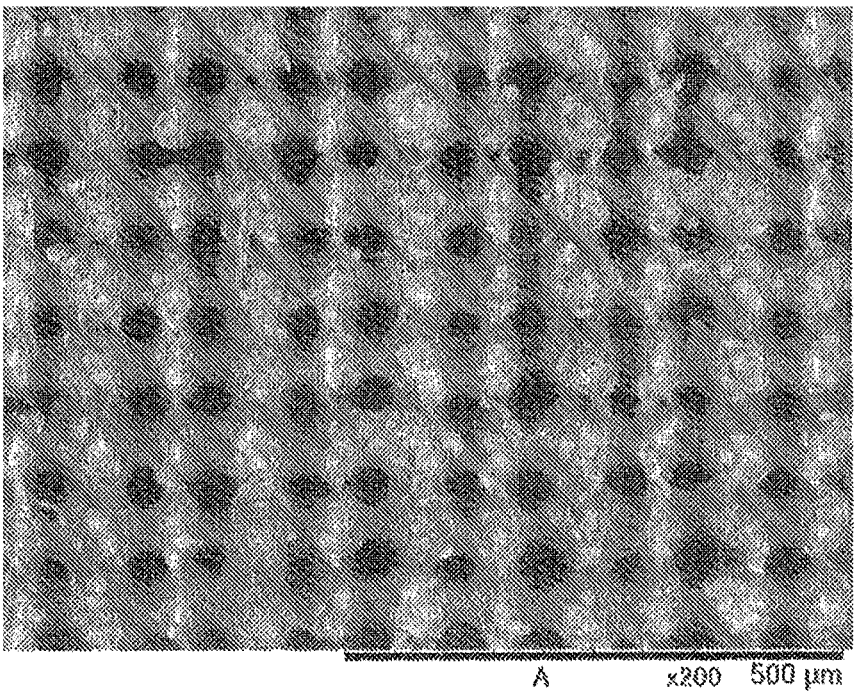
FIG. 10 is an SEM image of a rare earth magnet molded body having a roughened structure and obtained in Example 8.
Figure 11:
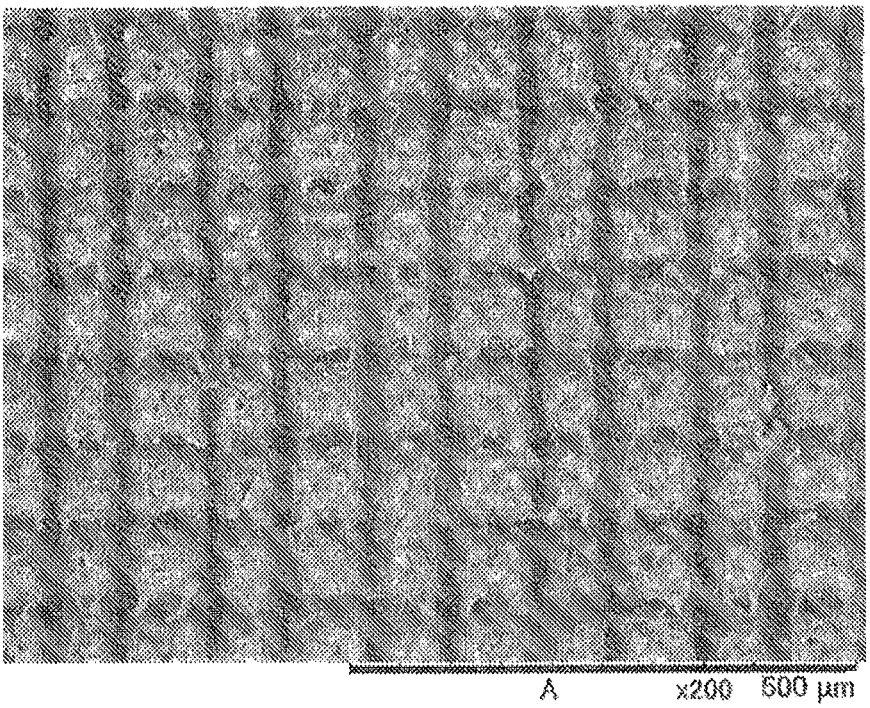
FIG. 11 is an SEM image of a rare earth magnet molded body having a roughened structure and obtained in Example 9.

The roughened structure of the embodiment 2a may have a plurality of islands surrounded by grooves (linear grooves) formed in mutually orthogonal directions, grooves (linear grooves) formed in mutually oblique directions, or grooves (linear grooves) formed in random directions, and furthermore, may include adjacent islands having portions that are cross-linked by projecting parts projected from the islands (refer to FIGS. 10 and 11).

Figure 27:
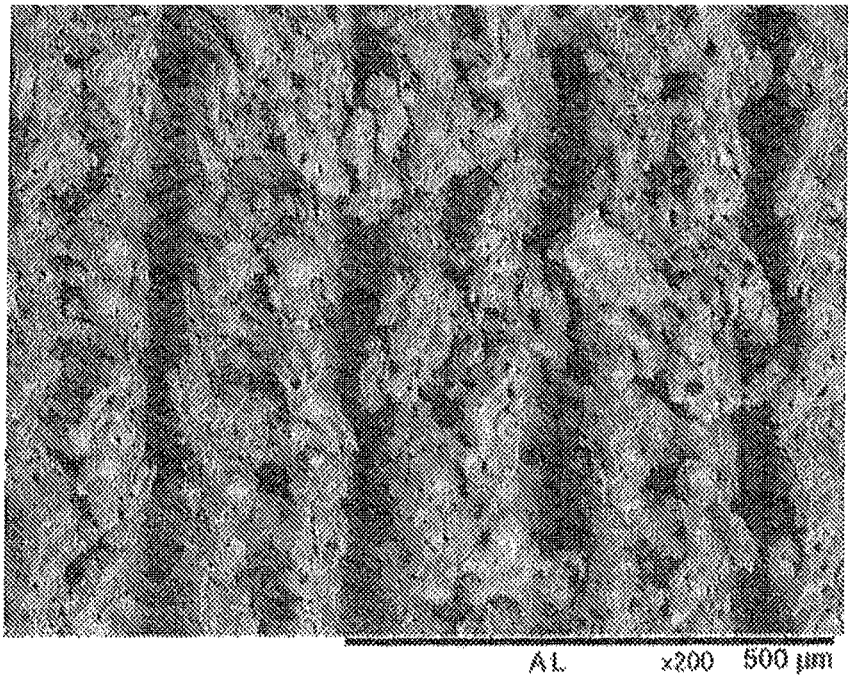
FIG. 27(*a*) is an SEM image of a surface of a rare earth magnet molded body having a roughened structure and obtained in Example 19, and FIG. 27(*b*) is a cross-sectional view in the thickness direction of FIG. 27(*a*).
Figure 27:
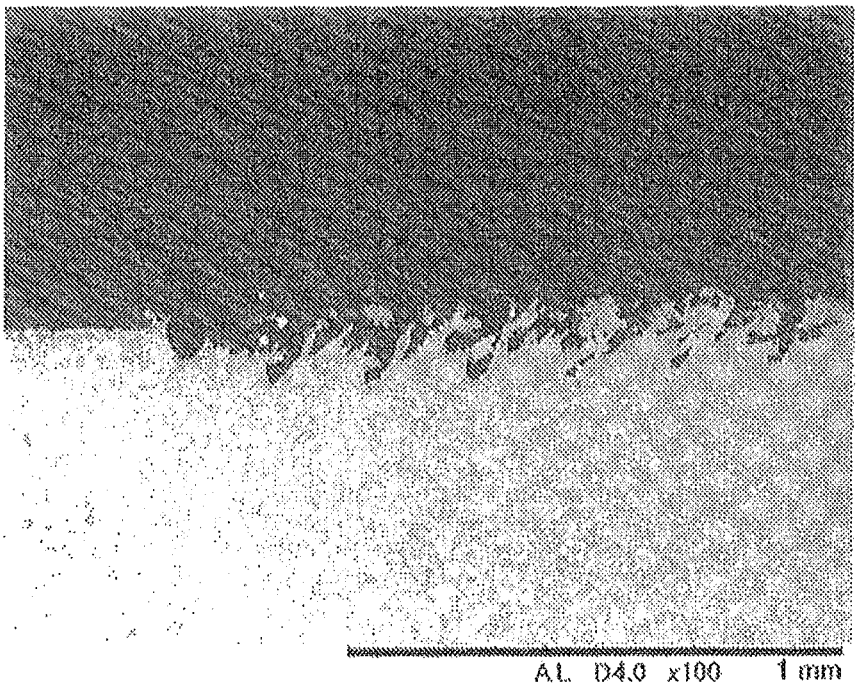

In the embodiment 2b, numerous independent recesses are present in a dispersed manner, and the periphery of these independent recesses is a protrusion (FIG. 24(*a*)). Note that the embodiment 2a may also include a form (FIG. 27(*a*)) that includes a structure in which partially discontinuous linear recesses and partially discontinuous linear protrusion are intermingled, extending in any one direction, without clear islands being formed when the groove depth in any one direction is shallow.

According to several examples of the present disclosure, the rare earth magnet precursor of the present disclosure can be magnetized by a known method, and then used as is or in combination with other members as a final product, or can be used as an intermediate product. The rare earth magnet molded body of the present disclosure may be only partially magnetized, and can then be used as is or in combination with other members as a final product.

<Method of Manufacturing a Rare Earth Magnet Precursor or Rare Earth Magnet Molded Body Having a Roughened Structure on Surface>

According to several examples of the present disclosure, a method of manufacturing a rare earth magnet precursor having a roughened structure on a surface may include forming a roughened structure on a surface of a molded body (hereinafter, simply referred to as a "raw molded body") that serves as a raw material of the rare earth magnet precursor. Here, the term "raw molded body" refers to a molded body on which a roughened structure is not formed and which is also not magnetized.

Additionally, according to several examples of the present disclosure, a method of manufacturing a magnetized rare earth magnet molded body having a roughened structure on a surface may include forming a roughened structure on the surface of the raw molded body, and magnetizing the molded body. Note that a "raw magnet molded body" in which a roughened structure is not formed on the surface but is magnetized can be used in place of the raw molded body. The "raw magnet molded body" is a molded body obtained by magnetizing a "raw molded body".

A method of manufacturing a rare earth magnet precursor having a roughened structure on a surface will be described below through several examples of the present disclosure. Note that in the method of forming a roughened structure described below, a roughened structure can be similarly formed even when the "raw magnet molded body" is used in place of the "raw molded body".

As a method of forming a roughened structure on the surface of the raw molded body, a machining method selected from blasting or use of sandpaper, a rasp, or a metal grinder such as a sander can be implemented. The raw molded body is a molded body that becomes a rare earth magnet by magnetization. The method of forming the roughened structure by blasting can implemented by a machining method selected from sand blasting, shot blasting, grit blasting, and bead blasting.

Another method of forming a roughened structure on the surface of a raw molded body is a method of using a continuous-wave laser (first usage method of continuous-wave laser beam). The method of using a continuous-wave laser can be used to form a roughened structure by continuously irradiating the surface of the raw molded body with a laser beam having an energy density of not less than 1 $MW/cm^2$ at an irradiation speed of not less than 2000 mm/sec.

When the surface of the raw molded body is continuously irradiated with a continuous-wave laser, the irradiation method of each of the following embodiments can be implemented.

(I) An embodiment in which when the surface of the raw molded body is continuously irradiated with a continuous-wave laser, the laser beam is continuously irradiated to form a plurality of lines including straight lines, curved lives, and combinations thereof in the same direction (roughened structure of the first embodiment) or in different directions (roughened structure of the second embodiment).

(II) An embodiment in which when the surface of the raw molded body is continuously irradiated with a continuous-wave laser, the laser beam is continuously irradiated to form a plurality of lines including straight lines, curved lives, and combinations thereof in the same direction (roughened structure of the first embodiment) or in different directions (roughened structure of the second embodiment), and the laser beam is continuously irradiated a plurality of times to form one straight line or one curved line.

(III) An embodiment in which when the surface of the raw molded body is continuously irradiated with a continuous-wave laser, the laser beam is continuously irradiated to form a plurality of lines including straight lines, curved lives, and combinations thereof in the same direction (roughened structure of the first embodiment) or in different directions (roughened structure of the second embodiment), and the laser beam is continuously irradiated to form the plurality of straight lines or the plurality of curved lines at equal intervals or at different intervals.

When forming the roughened structure of the first embodiment (embodiment 1a to embodiment 1d), bi-directional irradiation, unidirectional irradiation, or a combination thereof can be implemented. When forming the roughened structure of the second embodiment, cross irradiation in orthogonal directions, cross irradiation in oblique directions, or cross irradiation in random directions can be implemented.

In order to roughen the raw molded body, the irradiation speed of the laser beam may be 2000 mm/sec or higher, and may be 2800 mm/sec or higher in a preferred aspect of the present disclosure, from 2800 to 15000 mm/sec in another preferred aspect of the present disclosure, and from 3000 to 12000 mm/sec in yet another preferred aspect of the present disclosure.

The output of the laser may be from 50 to 1500 W in a preferred aspect of the present disclosure, from 50 to 1200 W in another preferred aspect of the present disclosure, and from 100 to 1000 W in yet another preferred aspect of the present disclosure.

The irradiation speed and output of the laser beam can be adjusted according to the type of raw molded body. For example, when a raw molded body containing neodymium is used as the raw molded body, the irradiation speed may be from 2800 to 15000 mm/sec in a preferred aspect of the present disclosure, may be from 3000 to 12000 mm/sec in another preferred aspect of the present disclosure, and may be from 4000 to 11000 mm/sec in yet another preferred aspect of the present disclosure, and the output may be from 50 to 800 W in a preferred aspect of the present disclosure, may be from 100 to 700 W in another preferred aspect of the present disclosure, and may be from 150 to 600 W in yet another preferred aspect of the present disclosure.

For example, when a raw molded body containing samarium cobalt is used as the raw molded body, the irradiation speed may be from 2800 to 15000 mm/sec in a preferred aspect of the present disclosure, may be from 3000 to 12000 mm/sec in another preferred aspect of the present disclosure, and may be from 4000 to 11000 mm/sec in yet another preferred aspect of the present disclosure, and the output may be from 50 to 800 W in a preferred aspect of the present disclosure, may be from 70 to 700 W in another preferred aspect of the present disclosure, and may be from 80 to 600 W in yet another preferred aspect of the present disclosure.

A spot diameter of the laser beam may be from 10 to 100 μm in a preferred aspect of the present disclosure, and may be from 10 to 75 μm in another preferred aspect of the present disclosure.

The energy density during laser beam irradiation may be 1 $MW/cm^2$ or higher, may be from 20 to 500 $MW/cm^2$ in a preferred aspect of the present disclosure, and may be from 30 to 300 $MW/cm^2$ in another preferred aspect of the present disclosure. The energy density during laser beam irradiation is determined from the output (W) of the laser beam and the laser beam spot surface area ($cm^2$) ($\pi\cdot[(\text{spot diameter})/2]^2$) using the following equation: (Output of Laser Beam)/(Spot Surface Area).

The number of repetitions (number of passes) during laser beam irradiation may be from 1 to 30 times in a preferred aspect of the present disclosure, may be from 3 to 20 times in another preferred aspect of the present disclosure, and may be from 3 to 15 times in yet another preferred aspect of the present disclosure. The number of repetitions when irradiating with the laser beam is the total number of times that the laser is irradiated to form one line (groove) when the laser beam is irradiated linearly.

Figure 2:
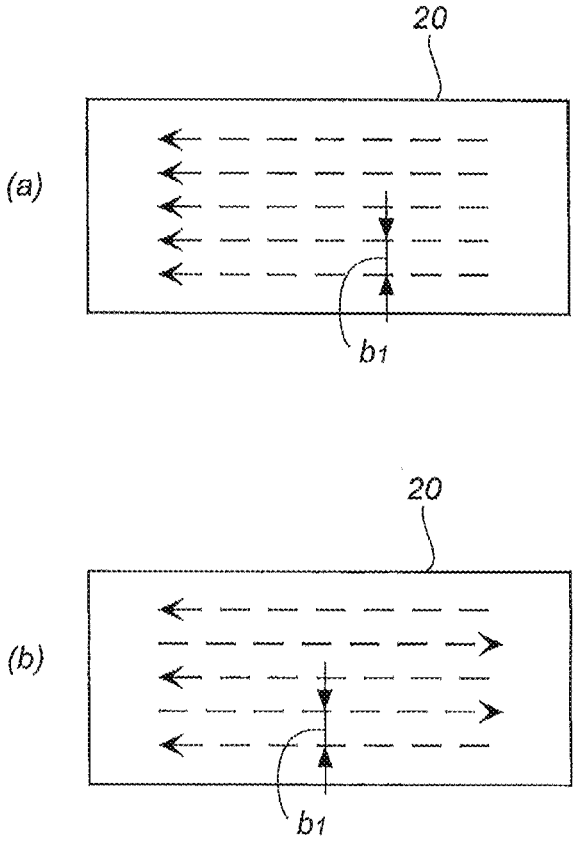
FIG. 2 illustrates diagrams of irradiation patterns of a laser beam when the second usage method of continuous-wave laser beam in one example of the present disclosure is implemented.

When the laser beam is to be repeatedly irradiated in a single line, bi-directional irradiation and unidirectional irradiation can be selected. Bi-directional irradiation is a method in which, when a single line (groove) is to be formed on a surface of a metal molded body 20 as illustrated in FIG. 2(*b*), the line (groove) is irradiated from a first end part to a second end part with a continuous-wave laser, after which the line is irradiated from the second end part to the first end part with the continuous-wave laser, and then repeatedly irradiated with the continuous-wave laser from the first end part to the second end part and then from the second end part to the first end part. Unidirectional irradiation is a method of repeatedly irradiating, as illustrated in FIG. 2(*a*), the surface of the metal molded body 20 in one line with the continuous-wave laser in one direction from the first end part to the second end part.

When linearly irradiating with the laser beam, an interval (line interval or pitch interval) between center positions in each width of the adjacent irradiation lines (grooves formed by adjacent irradiation) may be from 0.03 to 1.0 mm in a preferred aspect of the present disclosure, and may be from 0.03 to 0.2 mm in another preferred aspect of the present disclosure. The line intervals between all of the irradiation lines may be the same or may be different.

When the laser beam is irradiated, bi-directional irradiation or unidirectional irradiation is implemented at the line interval described above to form a plurality of grooves, after which cross irradiation can also be implemented through bi-directional irradiation or unidirectional irradiation at the above-mentioned line interval from a direction that is orthogonal or oblique to the plurality of grooves.

The wavelength of the laser beam may be from 300 to 1200 nm in a preferred aspect of the present disclosure, and from 500 to 1200 nm in another preferred aspect of the present disclosure. A defocus distance when irradiating with a laser beam may be from −5 to +5 mm in a preferred aspect of the present disclosure, from −1 to +1 mm in another preferred aspect of the present disclosure, and from −0.5 to +0.1 mm in yet another preferred aspect of the present disclosure. Laser irradiation may be performed with the defocus distance set to a constant value, or may be performed while changing the defocus distance. For example, when laser irradiation is performed, the defocus distance may be set to gradually decrease, or may be set to periodically increase and decrease.

A known continuous-wave laser can be used, and for example, a $YVO_4$ laser, a fiber laser (preferably a single-mode fiber laser), an excimer laser, a carbon dioxide laser, a UV laser, a YAG laser, a semiconductor laser, a glass laser, a ruby laser, a He—Ne laser, a nitrogen laser, a chelate laser, or a dye laser can be used. Of these, because of the increased energy density, a fiber laser is a preferred aspect of the present disclosure, and a single-mode fiber laser is another preferred aspect of the present disclosure.

According to several examples of the present disclosure, as yet another method for forming a roughened structure on the surface of the raw molded body, a method can be used in which when a continuous-wave laser is used to continuously irradiate the surface of the raw molded body with a laser beam having an energy density of not less than 1 $MW/cm^2$ at an irradiation speed of not less than 2000 mm/sec, irradiation is implemented to alternately produce irradiated portions irradiated with the laser beam and non-irradiated portions (second usage method of continuous-wave laser beam). The second usage method of continuous-wave laser beam is the same as the first usage method of continuous-wave laser beam described above, with the exception that the irradiation form of the laser beam differs.

In the second usage method of continuous-wave laser beam, when the laser beam is irradiated to form a straight line, a curved line, or a combination of straight and curved lines, the laser beam is irradiated to alternately produce irradiated portions irradiated with the laser beam and non-irradiated portions. Implementing irradiation to alternately produce irradiated portions irradiated with the laser beam and non-irradiated portions includes an embodiment of irradiation as illustrated in FIG. 1.

FIG. 1 illustrates a state in which a non-irradiated portion 12 of a certain length L2 is alternately generated between an irradiated portion 11 irradiated with laser beam and having a length L1 and an adjacent irradiated portion 11 irradiated with laser beam and having the length L1, resulting in formation of a dotted line as a whole. The dotted line may also include dot-dash lines, two dot-dash lines, and the like.

According to several examples of the present disclosure, when irradiation is performed a plurality of times, the irradiated portion irradiated with laser beam may be the same, or may be differed (the irradiated portion irradiated with laser beam may be shifted), and thereby an entire rare earth magnet molded body may be roughened.

When irradiation is performed a plurality of times on the same portion, the irradiation is implemented in a dotted line form. However, when irradiation is repeatedly performed while shifting the irradiated portions, i.e., shifting the irradiated portions to ensure that the irradiated portion irradiated by the laser beam overlaps a portion that was initially a non-irradiated portion not irradiated by the laser beam, irradiation is implemented eventually in a solid line state, even when irradiation is implemented in a dotted line form. The number of repetitions can be from 1 to 20 times.

Continuously irradiating a rare earth magnet molded body with a laser beam may lead to deformation such as cracking in a molded body with a small thickness. However, when laser irradiation is performed in a dotted line form as illustrated in FIG. 1, an irradiated portion 11 irradiated with laser beam and a non-irradiated portion 12 not irradiated with laser beam are alternately generated, and therefore when a laser beam is continuously irradiated, deformation such as cracking does not readily occur even in a molded body having a small thickness. Here, the same effect can be obtained even when the irradiated portions that are irradiated with laser beam are differed (irradiated portions irradiated with laser beam are shifted) as described above.

As the method of irradiation with a laser beam, a method of irradiating the surface of a metal molded body 20 with numerous lines in one direction as illustrated in FIG. 2(*a*), or a method for irradiating the surface of the metal molded body 20 with numerous dotted lines in both directions as illustrated in FIG. 2(*b*), may be used. Additionally, a method for irradiating to intersect dotted line irradiated portions, which are irradiated with the laser beam, may be used. An interval b1 between dotted lines after irradiation can be adjusted in accordance with, for example, the surface area of the metal molded body to be irradiated, but may be set to a range that is the same as the line interval of a first manufacturing method.

A length (L1) of the irradiated portion 11 irradiated with laser beam and a length (L2) of the non-irradiated portion 12 not irradiated with laser beam as illustrated in FIG. 1 can be adjusted to be within a range of L1/L2=1/9 to 9/1. In order to roughen into a complex porous structure, the length (L1) of the irradiated portion 11 irradiated with laser beam may be 0.05 mm or longer in a preferred aspect of the present disclosure, may be from 0.1 to 10 mm in another preferred aspect of the present disclosure, and may be from 0.3 to 7 mm in yet another preferred aspect of the present disclosure.

According to several examples of the present disclosure, in a preferred aspect of the present disclosure of the second usage method of continuous-wave laser, the process of irradiating with a laser beam as described above involves using a fiber laser device in which a direct-modulating type modulation device that directly converts a laser drive current is connected to a laser power supply, adjusting the duty ratio, and irradiating with laser beam.

There are two types of laser excitation: pulsed excitation and continuous excitation, and pulsed-wave lasers that are pulsed through pulsed excitation are commonly referred to as normal pulses.

A pulsed-wave laser can be produced even with continuous excitation. The pulsed-wave laser can be produced by: a Q-switched pulse oscillation method in which the pulse width (pulse ON time) is shortened relative to a normal pulse, thereby oscillating, by that amount, a laser having a higher peak power; an external modulation system that generates a pulsed-wave laser by temporally extracting light using an AOM or LN light intensity modulator; a method of pulsing the laser beam by mechanical chopping; a method of pulsing the laser beam by operating a galvano mirror; and a direct modulation system that directly modulates the laser drive current to produce a pulsed-wave laser.

The method of pulsing the laser beam by operating a galvano mirror involves irradiating a laser beam oscillated from a laser oscillator through a galvano mirror using a combination of a galvano mirror and a galvano controller, and specifically, can be implemented, for example, in the following manner.

The output of a gate signal from the galvano controller is periodically turned ON and OFF, and the laser beam oscillated by the laser oscillator is turned ON and OFF by the ON/OFF signal thereof, and thereby the laser beam is pulsed without changing the energy density of the laser beam. As a result, as illustrated in FIG. 1, the laser beam can be irradiated to alternately generate an irradiated portion 11 irradiated with laser beam, and a non-irradiated portion 12 not irradiated with laser beam and located between adjacent irradiated portions 11 irradiated with laser beam, resulting in the formation of a dotted line as a whole. With the method of pulsing the laser beam by operating a galvano mirror, the duty ratio can be adjusted without changing the oscillation state of the laser beam itself, and thus operations are simple.

Among these methods, the method of pulsing the laser beam by mechanical chopping, the method of pulsing the laser beam by operating a galvano mirror, and the direct modulation system that directly modulates the laser drive current to produce a pulsed-wave laser are preferable aspects of the present disclosure because pulsing (irradiation that alternately produces irradiated and non-irradiated portions) can be easily implemented without changing the energy density of the continuous-wave laser.

In one preferred aspect of the present disclosure, a fiber laser device in which a direct-modulating type modulation device that directly converts the laser drive current is connected to the laser power supply is used to continuously excite the laser and produce a pulsed-wave laser.

The duty ratio is a ratio determined by the following equation from the ON time and OFF time of the laser beam output.

$$\text{Duty Ratio (\%)}=(\text{ON time})/(\text{ON time}+\text{OFF time})\times 100$$

The duty ratio corresponds to L1 and L2 (namely, L1/(L1+L2)) illustrated in FIG. 1, and therefore can be selected from a range from 10 to 90%. The laser beam can be irradiated in a dotted line form like that illustrated in FIG. 1 by adjusting the duty ratio and irradiating the laser beam.

In order to roughen into a complex porous structure, the length (L1) of the irradiated portion 11 by laser beam may be 0.05 mm or longer in a preferred aspect of the present disclosure, may be from 0.1 to 10 mm in another preferred aspect of the present disclosure, and may be from 0.3 to 7 mm in yet another preferred aspect of the present disclosure.

According to several examples of the present disclosure, another method of forming a roughened structure on the surface of the raw molded body is a method using a pulsed-wave laser beam. When a pulsed-wave laser beam is irradiated, a roughened structure can be formed on the surface of the raw molded body by adjusting the following (i) to (v).

In addition to ordinary methods of irradiation with a pulsed-wave laser beam, the method of irradiation with a pulsed-wave laser beam can be performed in the same manner as the methods for irradiation with a pulsed-wave laser beam described in JP 5848104 B, JP 5788836 B, JP 5798534 B, JP 5798535 B, JP 2016-203643 A, JP 5889775 B, JP 5932700 B, and JP 6055529 B.

The roughened structures of the embodiments 1a to 1d can be formed by irradiating with a pulsed-wave laser beam in a manner satisfying the requirements of (i) to (v) below. When the roughened structure of the first embodiment (embodiment 1e) is to be formed, the pulsed-wave laser beam can be irradiated in a manner illustrated in FIG. 21(*b*) while satisfying the requirements (i) to (v) described below, and a plurality of circular recesses and annular protrusions can be formed (refer to FIG. 24(*a*)). When the roughened structure of the first embodiment (embodiment 1f) is to be formed, the pulsed-wave laser beam can be irradiated in a manner illustrated in FIG. 21(*a*) while satisfying the requirements (i) to (v) described below, and a plurality of circular recesses and annular protrusions can be formed (refer to FIG. 25).

<Requirement (i) Irradiation Angle when Irradiating the Raw Molded Body with a Pulsed-Wave Laser Beam>

The irradiation angle may be from 15 degrees to 90 degrees in a preferred aspect of the present disclosure, and may be from 45 to 90 degrees in another preferred aspect of the present disclosure.

<Requirement (ii) Irradiation Speed when Irradiating the Raw Molded Body with a Pulsed-Wave Laser Beam>

The irradiation speed may be from 10 to 1000 mm/sec in a preferred aspect of the present disclosure, may be from 10 to 500 mm/sec in another preferred aspect of the present disclosure, may be from 10 to 300 mm/sec in yet another preferred aspect of the present disclosure, and may be from 10 to 80 mm/sec in yet another preferred aspect of the present disclosure.

<Requirement (iii) Energy Density when Irradiating the Raw Molded Body with a Pulsed-Wave Laser Beam>

The energy density is determined from the energy output (W) of one pulse of the laser beam, and the laser beam spot surface area ($cm^2$) ($\pi\cdot[(\text{spot diameter})/2]^2$) using the following equation: (Output of laser beam)/(Spot surface area).

The energy density may be from 0.1 to 50 $GW/cm^2$ in a preferred aspect of the present disclosure, from 0.1 to 20 $GW/cm^2$ in another preferred aspect of the present disclosure, from 0.5 to 10 $GW/cm^2$ in yet another preferred aspect of the present disclosure, and from 0.5 to 5 $GW/cm^2$ in yet another preferred aspect of the present disclosure. As the energy density is increased, the pores become deeper and larger.

The energy output (W) of one pulse of the pulsed-wave laser beam is determined by the following equation.

$$\text{Energy output } (W) \text{ of one pulse of the pulsed-wave laser beam}=((\text{laser beam average output})/\text{frequency})/(\text{pulse width})$$

The average output may be from 4 to 400 W in a preferred aspect of the present disclosure, from 5 to 100 W in another preferred aspect of the disclosure, and from 10 to 100 W in yet another preferred aspect of the present disclosure. If other irradiation conditions of the laser beam are the same, as the output power increases, accordingly the pores become deeper and larger, and as the output power decreases, accordingly the pores become shallower and smaller.

The frequency (kHz) may be from 0.001 to 1000 kHz in a preferred aspect of the present disclosure, from 0.01 to 500 kHz in another preferred aspect of the present disclosure, and from 0.1 to 100 kHz in yet another preferred aspect of the present disclosure.

The pulse width (nsec) may be from 1 to 10000 nsec in a preferred aspect of the present disclosure, from 1 to 1000 nsec in another preferred aspect of the present disclosure, and from 10 to 100 nsec in yet another preferred aspect of the present disclosure.

The spot diameter (μm) of the laser beam may be from 1 to 300 μm in a preferred aspect of the present disclosure, from 10 to 300 μm in another preferred aspect of the present disclosure, from 20 to 150 μm in yet another preferred aspect of the present disclosure, and from 20 to 80 μm in yet another preferred aspect of the present disclosure.

<Requirement (iv) Number of Repetitions when Irradiating the Raw Molded Body with a Pulsed-Wave Laser Beam>

The number of repetitions is the total number of times of irradiation with the pulsed-wave laser beam required to form one dot (pore), and may be from 1 to 80 times in a preferred aspect of the present disclosure, from 3 to 50 times in another preferred aspect of the present disclosure, and from 5 to 30 times in yet another preferred aspect of the present disclosure. If the same laser irradiation conditions are used, as the number of repetitions increases, the pores (recesses)

become deeper and larger, and as the number of repetitions is reduced, the pores (recesses) become shallower and smaller.

Figure 21:
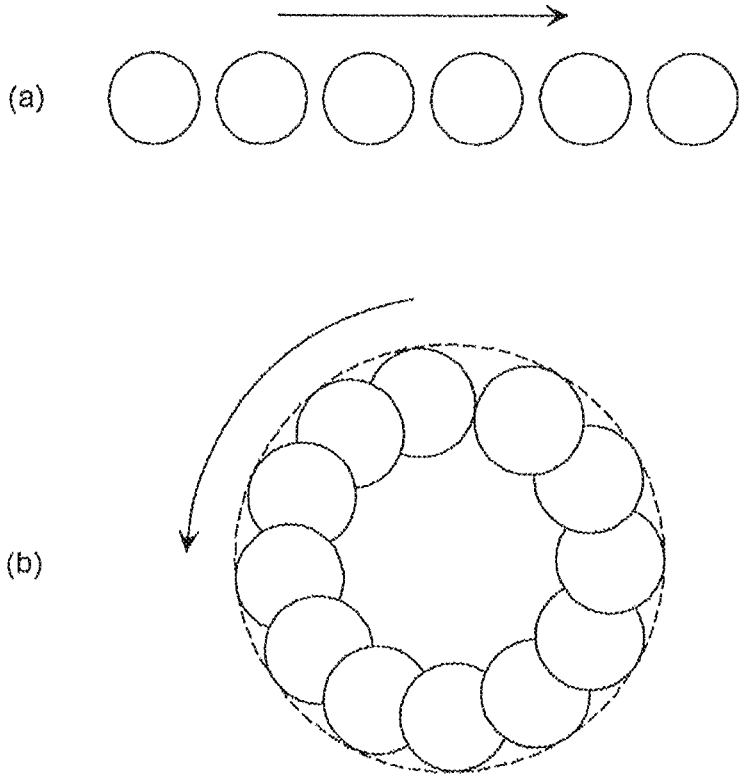
FIG. 21(*a*) is a schematic plan view illustrating a form in which a pulsed-wave laser beam is irradiated in a dot shape, and FIG. 21(*b*) is a schematic plan view illustrating a form in which a pulsed-wave laser beam is irradiated to form a circle.

However, according to several examples, the number of repetitions is applicable to an embodiment in which a pulsed-wave laser beam is irradiated to form a line (straight line, curved line, or a combination of straight lines and curved lines) (for example, refer to Examples 14, 15, 18, and 19), but is not applicable to an embodiment in which a pulsed-wave laser beam is irradiated to form a dot (FIG. 21(*a*); for example, refer to Example 17), an embodiment in which a pulsed-wave laser beam is irradiated to form a circle (FIG. 21(*b*); for example, refer to Example 16), or embodiments similar to these (embodiments in which irradiation is implemented to form a polygon, an ellipse, or the like).

<Requirement (v) Pitch Interval when Irradiating the Raw Molded Body with a Pulsed-Wave Laser Beam>

When a raw molded body is irradiated with a laser beam in a line shape, the interval (pitch) between adjacent linear recesses can be made wider or narrower, and thereby the size of the pores (recesses), the shape of the pores (recesses), and the depth of the pores (recesses) can be adjusted.

The pitch interval may be from 0.01 to 1 mm in a preferred aspect of the present disclosure, from 0.01 to 0.8 mm in another preferred aspect of the present disclosure, from 0.03 to 0.5 mm in yet another preferred aspect of the present disclosure, and from 0.05 to 0.5 mm in yet another preferred aspect of the present disclosure.

A narrow pitch has a thermal impact on adjacent linear recesses (lines), and therefore the pores become large, the shape of the pores becomes more complex, and the depth of the pores tends to become deeper, and if the thermal impact is too great, pores having a complex, deep shape are not easily formed. When the pitch is wide, the pores become smaller, the shape of the pores does not become complex, and the pores do not tend to become very deep, but the treatment speed can be increased.

Next, magnetization will be described. Magnetization can be implemented by either a first magnetization method (i.e., a method of magnetizing a rare earth magnet precursor) in which magnetization is implemented after a roughened structure has been formed on a raw molded body to produce a rare earth magnet precursor, or a second magnetization method in which magnetization is implemented once again after a roughened structure has been formed on a raw magnet molded body (a molded body that is magnetized before the roughened structure is formed).

If thermal impact is present in the formation of the roughened structure, magnetic properties may be impaired in some cases, and therefore a preferred aspect of the present disclosure is the first magnetization method. Thus, when a roughened structure is formed on the raw magnet molded body, even when the second magnetization method is not implemented, the raw magnet molded body can be used as a rare earth magnet molded body having a roughened structure, but the magnetic properties may be reduced.

With the first magnetization method, magnetization can be implemented once or a plurality of times after forming the roughened structure (forming a roughened structure to manufacture a rare earth magnet precursor). With the second magnetization method, magnetization can be implemented once or a plurality of times after the roughened structure has been formed on the rare earth magnet molded body. When magnetization is implemented a plurality of times in the first magnetization method and the second magnetization method, variations in the intensity of the magnetic force that is applied can be imparted in each process of magnetization.

According to several examples of the present disclosure, on the basis of the magnetic force (mT) (reference magnetic force) of the magnetized rare earth magnet molded body on which a roughened structure has not been formed being 100, the magnetic force (mT) when the rare earth magnet precursor having a roughened structure is subjected to a magnetization treatment may be at least 70% of the reference magnetic force in a preferred aspect of the present disclosure, at least 80% of the reference magnetic force in another preferred aspect of the present disclosure, and at least 90% of the reference magnetic force in yet another preferred aspect of the present disclosure. The magnetization can be implemented by a known magnetization method including, for example, a magnetization method using a magnetizing coil, and a magnetization method using a magnetizing yoke.

A method of manufacturing a composite molded body when the rare earth magnet molded body of the present disclosure is used as a manufacturing intermediate for manufacturing a composite molded body with a molded body containing another material is described.

(1) Method of Manufacturing a Composite Molded Body of a Rare Earth Magnet Precursor or a Rare Earth Magnet Molded Body and Resin Molded Body According to several examples of the present disclosure, in a first step, a rare earth magnet precursor having a roughened structure on a surface or a rare earth magnet molded body having a roughened structure on a surface is manufactured through the manufacturing method described above.

According to several examples of the present disclosure, in a second step, a portion including the roughened structure of the rare earth magnet precursor or rare earth magnet molded body obtained in the first step is arranged in a mold, and a resin that forms the resin molded body is injection molded, or in the second step, a portion including the roughened structure of the rare earth magnet precursor or rare earth magnet molded body obtained in the first step is arranged in a mold, and compression molding is implemented with at least the portion including the roughened structure and the resin that forms the resin molded body being in contact.

When a rare earth magnet molded body is used as the starting raw molded body of the composite molded body, a composite molded body that becomes a product can be manufactured by the first step and the second step, but when a rare earth magnet precursor is used as the starting raw molded body of the composite molded body, the composite molded body can be shipped as an intermediate product as is after the second step, or the composite molded body can be shipped as a product after a magnetization has been implemented.

Note that, according to several examples, when magnetization is implemented in the method of manufacturing a composite molded body, a manufacturing method including any of the following magnetization processes can be implemented.

(i) A method of subjecting the raw molded body to a first magnetization treatment, forming a roughened structure, manufacturing a composite molded body, and implementing a second magnetization treatment, in this order.

(ii) A method of forming a roughened structure on a raw molded body, implementing the first magnetization treatment, manufacturing a composite molded body, and implementing the second magnetization treatment, in this order.

(iii) A method of implementing the first magnetization treatment, forming the roughened structure, implementing the second magnetization treatment, manufacturing the composite molded body, and implementing a third magnetization treatment, in this order.

When magnetization is implemented a plurality of times in this manner, the same level of magnetic force may be imparted in all magnetization treatments, or different levels of magnetic force may be imparted in each magnetization treatment. When different levels of magnetic force are to be imparted, in the methods of (i) and (ii), the magnetic force for magnetization can be increased in the order of the first magnetization treatment and the second magnetization treatment, and in the method of (iii), the magnetic force for magnetization can be increased in the order of the first, second, and third magnetization treatments.

For example, when a mold is used in the process of manufacturing a composite molded body, if the magnetic force is overly strong, the rare earth magnet precursor (or rare earth magnet) on which the roughened structure is formed will attach to the mold with a strong force and not detach, which is inconvenient, and if a weak magnetic force is used, the rare earth magnet precursor (or rare earth magnet) is easily attached to and removed from the mold. Also, the magnetic force is attenuated by heat when the roughened structure is formed, but a restoration level of the attenuated magnetic force can be increased by implementing magnetization a plurality of times as described above.

Examples of the resin used in the second step include thermoplastic resins, thermosetting resins, and thermoplastic elastomers. The thermoplastic resin can be appropriately selected from known thermoplastic resins according to the application. Examples include polyamide resins (aliphatic polyamides such as PA6 and PA66, and aromatic polyamides), polystyrene, copolymers containing styrene units such as ABS resin or AS resin, polyethylene, copolymers containing ethylene units, polypropylene, copolymers containing propylene units, other polyolefins, polyvinyl chloride, polyvinylidene chloride, polycarbonate resins, acrylic resins, methacrylic resins, polyester resins, polyacetal resins, and polyphenylene sulfide resins.

The thermosetting resin can be appropriately selected from known thermosetting resins according to the application. Examples include urea resins, melamine resins, phenolic resins, resorcinol resins, epoxy resins, polyurethanes, and vinyl urethanes. When a thermosetting resin is used, a prepolymer form can be used, and a heat curing treatment can be implemented in a subsequent process.

The thermoplastic elastomer can be appropriately selected from known thermoplastic elastomers according to the application. Examples thereof include styrene-based elastomers, vinyl chloride-based elastomers, olefin-based elastomers, urethane-based elastomers, polyester-based elastomers, nitrile-based elastomers, and polyamide-based elastomers.

Known fibrous fillers can be blended in these thermoplastic resins, thermosetting resins, and thermoplastic elastomers. Examples of known fibrous fillers include carbon fibers, inorganic fibers, metal fibers, and organic fibers. Well-known carbon fibers can be used including, for example, PAN-based, pitch-based, rayon-based, and lignin-based carbon fibers. Examples of the inorganic fibers include glass fibers, basalt fibers, silica fibers, silica alumina fibers, zirconia fibers, boron nitride fibers, and silicon nitride fibers. Examples of the metal fibers include fibers made from stainless steel, aluminum, copper, and the like. Examples of organic fibers that can be used include synthetic fibers such as polyamide fibers (wholly aromatic polyamide fibers, semi-aromatic polyamide fibers in which either diamine or dicarboxylic acid is an aromatic compound, aliphatic polyamide fibers), polyvinyl alcohol fibers, acrylic fibers, polyolefin fibers, polyoxymethylene fibers, polytetrafluoroethylene fibers, polyester fibers (including wholly aromatic polyester fibers), polyphenylene sulfide fibers, polyimide fibers, and liquid crystal polyester fibers, natural fibers (such as cellulose-based fibers), and regenerated cellulose (rayon) fibers.

These fibrous fillers having a fiber diameter in a range from 3 to 60 μm can be used, but among these, in a preferred aspect of the present disclosure, a fibrous filler with a fiber diameter smaller than an opening diameter of an opened pore or the like formed by roughening a bonding surface of the metal molded body is used. The fiber diameter may be from 5 to 30 μm in a preferred aspect of the present disclosure, and may be from 7 to 20 μm in another preferred aspect of the present disclosure.

The compounded amount of the fibrous filler per 100 parts by mass of the thermoplastic resin, the thermosetting resin, or the thermoplastic elastomer may be from 5 to 250 parts by mass in a preferred aspect of the present disclosure, from 25 to 200 parts by mass in another preferred aspect of the present disclosure, and from 45 to 150 parts by mass in yet another preferred aspect of the present disclosure.

(2-1) Method of Manufacturing a Composite Molded Body of a Rubber Molded Body and a Rare Earth Magnet Precursor Having a Roughened Structure or a Rare Earth Magnet Molded Body Having a Roughened Structure According to several examples of the present disclosure, in a first step, a rare earth magnet precursor having a roughened structure on a surface or a rare earth magnet molded body having a roughened structure on a surface is manufactured through the manufacturing method described above.

According to several examples of the present disclosure, in a second step, a rubber molded body and the rare earth magnet precursor or the rare earth magnet molded body obtained in the first step are integrated by applying a known molding method such as press molding or transfer molding. When a press molding method is applied, for example, a portion including the roughened structure of the rare earth magnet precursor or the rare earth magnet molded body is arranged in a mold, and an uncured rubber for forming the rubber molded body is pressed in a state of being heated and pressurized against the portion including the roughened structure, and then cooled, and the resulting product is subsequently removed. When a transfer molding method is applied, for example, a portion including the roughened structure of the rare earth magnet precursor or the rare earth magnet molded body is arranged in a mold, and an uncured rubber is injection molded inside the mold, and then heated and pressurized to integrate the rubber molded body with the portion including the roughened structure of the rare earth magnet precursor or the rare earth magnet molded body, and the integrated product is subsequently cooled, and then removed.

Note that, depending on the type of rubber that is used, after the product has been removed from the mold, secondary heating (secondary curing) in an oven or the like can be added to remove primarily residual monomers.

When a rare earth magnet molded body is used as the starting raw molded body of the composite molded body, a composite molded body that becomes a product can be manufactured by the first step and the second step, but when a rare earth magnet precursor is used as the starting raw molded body of the composite molded body, the composite molded body can be shipped as an intermediate product as is after the second step, or the composite molded body can be shipped as a product after a magnetization has been implemented.

According to several examples of the present disclosure, the rubber of the rubber molded body used in this step is not particularly limited, and a known rubber can be used, but a thermoplastic elastomer is not included. Examples of known rubbers that can be used include ethylene-α-olefin rubbers such as an ethylene-propylene copolymer (EPM), ethylene-propylene-diene terpolymer (EPDM), ethylene-octene copolymer (EOM), ethylene-butene copolymer (EBM), ethylene-octene terpolymer (EODM), and ethylene-butene terpolymer (EBDM); and ethylene/acrylic acid rubber (EAM), polychloroprene rubber (CR), acrylonitrile-butadiene rubber (NBR), hydrogenated NBR (HNBR), styrene-butadiene rubber (SBR), alkylated chlorosulfonated polyethylene (ACSM), epichlorohydrin (ECO), polybutadiene rubber (BR), natural rubber (including synthetic polyisoprene) (NR), chlorinated polyethylene (CPE), brominated polymethylstyrene-butene copolymer, styrene-butadiene-styrene and styrene-ethylene-butadiene-styrene block copolymers, acrylic rubber (ACM), ethylene-vinyl acetate elastomer (EVM), and silicone rubber.

The rubber may contain, as necessary, a curing agent according to the type of rubber, and other known rubber additives can be compounded. Examples of rubber additives that can be used include curing accelerators, anti-aging agents, silane coupling agents, reinforcing agents, flame retardants, ozone deterioration inhibitors, fillers, process oils, plasticizers, tackifiers, and processing aids.

(2-2) Method of Manufacturing a Composite Molded Body (with an Adhesive Layer) of a Rubber Molded Body and a Rare Earth Magnet Precursor Having a Roughened Structure or a Rare Earth Magnet Molded Body Having a Roughened Structure According to several examples of the present disclosure, in the method for manufacturing a composite molded body of a rubber molded body and a rare earth magnet precursor or a rare earth magnet molded body, an adhesive layer can be interposed between the bonding surface of the rubber molded body and the rare earth magnet precursor or the rare earth magnet molded body.

According to several examples of the present disclosure, in a first step, a rare earth magnet precursor having a roughened structure on a surface or a rare earth magnet molded body having a roughened structure on a surface is manufactured through the manufacturing method described above.

According to several examples of the present disclosure, in the second step, an adhesive (adhesive solution) is applied to the roughened surface of the rare earth magnet precursor or rare earth magnet molded body to form an adhesive layer. Here, the adhesive may be pressed onto the roughened structure surface. By applying the adhesive, the adhesive is present on the roughened structure surface of the rare earth magnet precursor or rare earth magnet molded body and in internal pores.

The adhesive is not particularly limited, and known adhesives such as thermoplastic adhesives, thermosetting adhesives, rubber-based adhesives, and moisture-curable adhesives can be used. Examples of thermoplastic adhesives include polyvinyl acetates, polyvinyl alcohols, polyvinyl formals, polyvinyl butyrals, acrylic adhesives, polyethylene, chlorinated polyethylene, ethylene-vinyl acetate copolymers, ethylene-vinyl alcohol copolymers, ethylene-ethyl acrylate copolymers, ethylene-acrylic acid copolymers, ionomers, chlorinated polypropylenes, polystyrenes, polyvinyl chlorides, plastisols, vinyl chloride-vinyl acetate copolymers, polyvinyl ethers, polyvinylpyrrolidone, polyamides, nylons, saturated amorphous polyesters, and cellulose derivatives. Examples of thermosetting adhesives include urea resins, melamine resins, phenolic resins, resorcinol resins, epoxy resins, polyurethanes, and vinyl urethanes. Examples of rubber-based adhesives include natural rubbers, synthetic polyisoprenes, polychloroprenes, nitrile rubbers, styrene-butadiene rubbers, styrene-butadiene-vinylpyridine terpolymers, polyisobutylene-butyl rubber, polysulfide rubbers, silicone RTV, rubber chlorides, rubber bromides, kraft rubbers, block copolymers, and liquid rubbers. Examples of moisture-curable adhesives include cyanoacrylate-based instantaneous adhesives.

According to several examples of the present disclosure, in a third step, a separately molded rubber molded body is adhered to a surface of a rare earth magnet precursor or rare earth magnet molded body on which an adhesive layer was formed in the previous step, or a portion including a surface of the rare earth magnet precursor or rare earth magnet molded body on which an adhesive layer was formed in the previous step is arranged in a mold, and the surface of the rare earth magnet precursor or rare earth magnet molded body and an uncured rubber that forms a rubber molded body are brought into contact with each other and integrated through heating and pressurization. Note that after the product has been removed from the mold, secondary heating (secondary curing) in an oven or the like can be implemented to remove primarily residual monomers.

When a rare earth magnet molded body is used as the starting raw molded body of the composite molded body, a composite molded body that becomes a product can be manufactured by the first step and the second step, but when a rare earth magnet precursor is used as the starting raw molded body of the composite molded body, the composite molded body can be shipped as an intermediate product as is after the second step, or the composite molded body can be shipped as a product after a magnetization has been implemented.

(3-1) Method of Manufacturing a Composite Molded Body of a Metal Molded Body and a Rare Earth Magnet Precursor Having a Roughened Structure or a Rare Earth Magnet Molded Body Having a Roughened Structure According to several examples of the present disclosure, in a first step, a rare earth magnet precursor having a roughened structure or a rare earth magnet molded body having a roughened structure is manufactured through the manufacturing method described above.

According to several examples of the present disclosure, in a second step, the roughened rare earth magnet precursor or rare earth magnet molded body is arranged inside a mold with the surface including the roughened structure portion oriented toward the top. Subsequently, for example, a well-known die casting method is used, and a molten metal is poured into the mold and then cooled.

The metal used is not limited as long as the metal has a melting point that is lower than the melting point of the rare earth magnet constituting the rare earth magnet precursor or rare earth magnet molded body. For example, a metal can be selected according to the application of the composite molded body, and examples include iron, aluminum, aluminum alloys, gold, silver, platinum, copper, magnesium, titanium, or alloys thereof, and stainless steel.

When a rare earth magnet molded body is used as the starting raw molded body of the composite molded body, a composite molded body that becomes a product can be manufactured by the first step and the second step, but when a rare earth magnet precursor is used as the starting raw molded body of the composite molded body, the composite molded body can be shipped as an intermediate product as is after the second step, or the composite molded body can be shipped as a product after a magnetization has been implemented.

(3-2) Method of Manufacturing a Composite Molded Body (with an Adhesive Layer) with a Rare Earth Magnet Precursor Having a Roughened Structure or a Rare Earth Magnet Molded Body Having a Roughened Structure According to several examples of the present disclosure, a first step and a second step are implemented in the same manner as the first step and the second step of the above-described "(2-2) Method of manufacturing a composite molded body (with an adhesive layer) of a rubber molded body and a rare earth magnet precursor having a roughened structure or a rare earth magnet precursor having a roughened structure", and a rare earth magnet molded body having an adhesive layer is manufactured.

According to several examples of the present disclosure, in a third step, a metal molded body is pressed onto the adhesive layer of the rare earth magnet precursor or rare earth magnet molded body having a roughened structure with an adhesive layer, and is adhered and integrated. When the adhesive layer is formed from a thermoplastic resin-based adhesive, as necessary, the adhesive layer can be heated and adhered in a softened state to an adhering surface of a non-metal molded body. Furthermore, when the adhesive layer is formed from a prepolymer of a thermosetting resin-based adhesive, the prepolymer is heated and cured by being left in a heated atmosphere after adhering.

When a rare earth magnet molded body is used as the starting raw molded body of the composite molded body, a composite molded body that becomes a product can be manufactured by the first step and the second step, but when a rare earth magnet precursor is used as the starting raw molded body of the composite molded body, the composite molded body can be shipped as an intermediate product as is after the second step, or the composite molded body can be shipped as a product after a magnetization has been implemented.

(4) Method of Manufacturing a Composite Molded Body of a UV Curable Resin Molded Body and a Rare Earth Magnet Precursor Having a Roughened Structure or a Rare Earth Magnet Molded Body Having a Roughened Structure According to several examples of the present disclosure, in a first step, a rare earth magnet precursor having a roughened structure on a surface or a rare earth magnet molded body having a roughened structure on a surface is manufactured through the manufacturing method described above.

According to several examples of the present disclosure, in the next step, the monomer, oligomer, or mixture thereof that forms the UV curable resin layer is brought into contact with a portion that includes the roughened structure portion of the rare-earth magnet precursor or rare earth magnet molded body (contacting with a monomer, oligomer, or mixture thereof).

The contacting with a monomer, oligomer, or mixture thereof can be implemented by applying the monomer, oligomer, or mixture thereof to a portion that includes the roughened structure portion of the rare earth magnet precursor or rare earth magnet molded body. The monomer, oligomer, or mixture thereof can be applied through methods such as brush coating, application using a doctor blade, roller coating, casting, or potting, and these methods can be used alone or in a combination.

The contacting with a monomer, oligomer, or mixture thereof can be implemented by surrounding, with a form, the portion including the roughened structure portion of the rare earth magnet precursor or rare earth magnet molded body, and injecting the monomer, oligomer, or mixture thereof into the form. The contacting with a monomer, oligomer, or mixture thereof can also be implemented by inserting the rare earth magnet precursor or rare earth magnet molded body into a mold with the roughened portion oriented toward the top, and then injecting the monomer, oligomer, or mixture thereof into the mold.

Through the process of causing contact with the monomer, oligomer, or mixture thereof, the monomer, oligomer, or mixture thereof penetrates into the pores of the roughened portion of the rare earth magnet precursor or rare earth magnet molded body. Forms in which the monomer, oligomer, or mixture thereof penetrates into pores include, for example, forms in which the monomer, oligomer, or mixture thereof penetrates into 50% or more of the overall pores in one preferred aspect of the present disclosure, 70% or more in another preferred aspect of the present disclosure, 80% or more in another preferred aspect of the present disclosure, and 90% or more in another preferred aspect of the present disclosure, as well as a form in which the monomer, oligomer, or mixture thereof penetrates to the bottom of the pores, a form in which the monomer, oligomer, or mixture thereof penetrates to a depth midway of the pore depth, and a form in which the monomer, oligomer, or mixture thereof is penetrates only the vicinity of the inlet of the pores.

According to several examples of the present disclosure, the monomer, oligomer, or mixture thereof that is in a liquid state (including a gel with a low viscosity) at normal temperature or that is in a solution form obtained by dissolving in a solvent can be applied or injected as is, and a solid (powder) of the monomer, oligomer, or mixture thereof can be applied or injected after being heated and melted or dissolved in a solvent.

According to several examples of the present disclosure, the monomer, oligomer, or mixture thereof used in the process of contacting with a monomer, oligomer, or mixture thereof may be selected from a radically polymerizable monomer and an oligomer of a radically polymerizable monomer, or may be selected from a cationically polymerizable monomer and a cationically polymerizable monomer oligomer of the monomer or a mixture of two or more types selected from these.

Radically Polymerizable Monomer

Examples of radically polymerizable compounds include compounds having, per molecule, one or more radically polymerizable groups, such as (meth)acryloyl groups, (meth)acryloyloxy groups, (meth)acryloyl amino groups, vinyl ether groups, vinyl aryl groups, and vinyloxycarbonyl groups.

Examples of compounds having one or more (meth) acrylic groups per molecule include 1-buten-3-one, 1-penten-3-one, 1-hexen-3-one, 4-phenyl-1-buten-3-one, 5-phenyl-1-penten-3-one, and derivatives thereof.

Examples of compounds having one or more (meth) acryloyloxy group per molecule include methyl (meth) acrylate, ethyl (meth)acrylate, n-butyl (meth)acrylate, isobutyl (meth)acrylate, t-butyl (meth)acrylate, n-hexyl (meth)acrylate, 2-ethylhexyl (meth)acrylate, isodecyl (meth)acrylate, n-lauryl (meth)acrylate, n-stearyl (meth) acrylate, n-butoxyethyl (meth)acrylate, butoxy diethylene glycol (meth)acrylate, methoxy triethylene glycol (meth)

acrylate, methoxy polyethylene glycol (meth)acrylate, cyclohexyl (meth)acrylate, tetrahydrofurfuryl (meth)acrylate, benzyl (meth)acrylate, phenoxyethyl (meth)acrylate, isobornyl (meth)acrylate, 2-hydroxyethyl (meth)acrylate, 2-hydroxypropyl (meth)acrylate, 2-hydroxybutyl (meth) acrylate, dimethylaminoethyl (meth)acrylate, diethylaminoethyl (meth)acrylate, acrylic acid, methacrylic acid, 2-(meth)acryloyloxyethyl succinate, 2-(meth)acryloyloxyethyl hexahydrophthalic acid, 2-(meth)acryloyloxyethyl-2-hydroxypropyl phthalate, glycidyl (meth)acrylate, 2-(meth) acryloyloxyethyl acid phosphate, ethylene glycol di(meth) acrylate, diethylene glycol di(meth)acrylate, triethylene glycol di(meth)acrylate, 1,4-butanediol di(meth)acrylate, neopentyl glycol di(meth)acrylate, 1,6-hexanediol di(meth) acrylate, 1,9-nonanediol di(meth)acrylate, 1,10-decanediol di(meth)acrylate, decane di(meth)acrylate, glycerin di(meth)acrylate, 2-hydroxy-3-(meth)acryloyloxypropyl (meth) acrylate, dimethylol tricyclodecane di(meth)acrylate, trifluoroethyl (meth)acrylate, perfluorooctyl ethyl (meth) acrylate, isoamyl (meth)acrylate, isomyristyl (meth) acrylate, γ-(meth)acryloyloxypropyl trimethoxysilane, 2-(meth)acryloyloxyethyl isocyanate, 1,1-bis(acryloyloxy) ethyl isocyanate, 2-(2-(meth)acryloyloxy ethyloxy)ethyl isocyanate, 3-(meth)acryloyloxypropyl triethoxysilane, and derivatives thereof.

Examples of compounds having one or more (meth) acryloylamino group per molecule include 4-(meth)acryloylmorpholine, N,N-dimethyl (meth)acrylamide, N,N-diethyl (meth)acrylamide, N-methyl (meth)acrylamide, N-ethyl (meth)acrylamide, N-propyl (meth)acrylamide, N-isopropyl (meth)acrylamide, N-butyl (meth)acrylamide, N-n-butoxymethyl (meth)acrylamide, N-hexyl (meth)acrylamide, N-octyl (meth)acrylamide, and derivatives thereof.

Examples of compounds having one or more vinyl ether groups per molecule include 3,3-bis(vinyloxymethyl)oxetane, 2-hydroxyethyl vinyl ether, 3-hydroxypropyl vinyl ether, 2-hydroxypropyl vinyl ether, 2-hydroxyisopropyl vinyl ether, 4-hydroxybutyl vinyl ether, 3-hydroxybutyl vinyl ether, 2-hydroxybutyl vinyl ether, 3-hydroxyisobutyl vinyl ether, 2-hydroxyisobutyl vinyl ether, 1-methyl-3-hydroxypropyl vinyl ether, 1-methyl-2-hydroxypropyl vinyl ether, 1-hydroxymethylpropyl vinyl ether, 4-hydroxycyclohexyl vinyl ether, 1,6-hexanediol monovinyl ether, 1,4-cyclohexane dimethanolmonovinyl ether, 1,3-cyclohexane dimethanol monovinyl ether, 1,2-cyclohexane dimethanol monovinyl ether, p-xylene glycol monovinyl ether, m-xylene glycol monovinyl ether, o-xylene, glycol monovinyl ether, diethylene glycol monovinyl ether, triethylene glycol monovinyl ether, tetraethylene glycol monovinyl ether, pentaethylene glycol monovinyl ether, oligoethylene glycol monovinyl ether, polyethylene glycol monovinyl ether, dipropylene glycol monovinyl ether, tripropylene glycol monovinyl ether, tetrapropylene glycol monovinyl ether, pentapropylene glycol monovinyl ether, oligopropylene glycol monovinyl ether, polypropylene glycol monovinyl ether, and derivatives thereof.

Examples of compounds having one or more vinyl aryl groups per molecule include styrene, divinylbenzene, methoxystyrene, ethoxystyrene, hydroxystyrene, vinyl naphthalene, vinyl anthracene, 4-vinylphenyl acetate, (4-vinylphenyl)dihydroxyborane, N-(4-vinylphenyl)maleimide, and derivatives thereof.

Examples of compounds having one or more vinyloxycarbonyl groups per molecule include isopropenyl formate, isopropenyl acetate, isopropenyl propionate, isopropenyl butyrate, isopropenyl isobutyrate, isopropenyl caproate, isopropenyl valerate, isopropenyl isovalerate, isopropenyl lactate, vinyl acetate, vinyl propionate, vinyl butyrate, vinyl caproate, vinyl caprylate, vinyl laurate, vinyl myristate, vinyl palmitate, vinyl stearate, vinyl cyclohexane carboxylate, vinyl pivalate, vinyl octylate, vinyl monochloroacetate, divinyl adipate, vinyl acrylate, vinyl methacrylate, vinyl crotonate, vinyl sorbate, vinyl benzoate, vinyl cinnamate, and derivatives thereof.

Cationically Polymerizable Monomers

Examples of cationically polymerizable monomers include compounds having, per molecule, one or more cationically polymerizable group other than an oxetanyl group, etc., such as an epoxy ring (oxiranyl group), a vinyl ether group, and a vinyl aryl group.

Examples of compounds having one or more epoxy rings per molecule include glycidyl methyl ether, bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolac resin, hydrogenated bisphenol A diglycidyl ether, hydrogenated bisphenol F diglycidyl ether, hydrogenated bisphenol S diglycidyl ether, 3,4-epoxycyclohexylmethyl(3,4-epoxy)cyclohexane carboxylate, 2-(3,4-epoxycyclohexyl-5,5-spiro-3,4-epoxy) cyclohexane-meta-dioxane, bis (3,4-epoxycyclohexylmethyl)adipate, bis(3,4-epoxy-6-methylcyclohexylmethyl) adipate, 3,4-epoxy-6-methylcyclohexyl-3',4'-epoxy-6'-methylcyclohexane carboxylate, methylene bis(3,4-epoxycyclohexane), dicyclopentadiene diepoxide, di(3,4-epoxycyclohexylmethyl)ether of ethylene glycol, ethylene bis(3,4-epoxycyclohexane carboxylate), dioctyl epoxy hexahydrophthalate, di-2-ethylhexyl epoxy hexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ethers; polyglycidyl ethers of polyether polyols obtained by adding one or more alkylene oxides to an aliphatic polyhydric alcohol such as ethylene glycol, propylene glycol and glycerin; diglycidyl esters of aliphatic long chain dibasic acids; monoglycidyl ethers of aliphatic higher alcohols; monoglycidyl ethers of phenol, cresol, butyl phenol, or of polyether alcohols obtained by adding an alkylene oxide to these; and glycidyl esters of higher fatty acids.

Examples of compounds having one or more vinyl ether groups per molecule and of compounds having one or more vinyl aryl groups per molecule include the same compounds as those compounds exemplified as radically polymerizable compounds.

Examples of compounds having one or more oxetanyl groups per molecule include trimethylene oxide, 3,3-bis (vinyloxymethyl)oxetane, 3-ethyl-3-hydroxymethyl oxetane, 3-ethyl-3-(2-ethylhexyl oxymethyl)oxetane, 3-ethyl-3-(hydroxymethyl)oxetane, 3-ethyl-3-[(phenoxy)methyl] oxetane, 3-ethyl-3-(hexyloxymethyl)oxetane, 3-ethyl-3-(chloromethyl)oxetane, 3,3-bis(chloromethyl)oxetane, 1,4-bis[(3-ethyl-3-oxetanylmethoxy)methyl]benzene, bis{[1-ethyl(3-oxetanyl)]methyl}ether, 4,4'-bis[(3-ethyl-3-oxetanyl)methoxymethyl]bicyclohexyl, 1,4-bis[(3-ethyl-3-oxetanyl)methoxymethyl]cyclohexane, and 3-ethyl-3{[(3-ethyloxetan-3-yl)methoxy]methyl}oxetane.

Examples of oligomers of the radically polymerizable monomer and the cationically polymerizable monomer include monofunctional or multifunctional (meth)acrylic-based oligomers. One type or a combination of two or more types can be used. Examples of the monofunctional or multifunctional (meth)acrylic-based oligomers include urethane (meth)acrylate oligomers, epoxy (meth)acrylate oligomers, polyether (meth)acrylate oligomers, and polyester (meth)acrylate oligomers.

Examples of urethane (meth)acrylate oligomers include polycarbonate-based urethane (meth)acrylate, polyester-based urethane (meth)acrylate, polyether-based urethane (meth)acrylate, and caprolactone-based urethane (meth) acrylate. The urethane (meth)acrylate oligomer can be obtained through a reaction between a (meth)acrylate monomer having a hydroxyl group, and an isocyanate compound obtained by reacting a polyol with diisocyanate. Examples of the polyol include polycarbonate diols, polyester polyols, polyether polyols, and polycaprolactone polyols.

The epoxy (meth)acrylate oligomer is obtained by, for example, an esterification reaction between acrylic acid and an oxirane ring of a low molecular weight bisphenol type epoxy resin or a novolac epoxy resin. The polyether (meth) acrylate oligomer is obtained by obtaining a polyether oligomer having hydroxyl groups at both ends through a dehydration condensation reaction of a polyol, followed by subjecting the hydroxyl groups at both ends to esterification with acrylic acid. The polyester (meth)acrylate oligomer is obtained, for example, by obtaining a polyester oligomer having hydroxyl groups at both ends through condensation of a polycarboxylic acid and a polyol, followed by subjecting the hydroxyl groups at both ends to esterification with acrylic acid.

According to several examples of the present disclosure, the weight average molecular weight of the monofunctional or multifunctional (meth)acrylic oligomer may be 100000 or less in a preferred aspect of the present disclosure, and may be from 500 to 50000 in another preferred aspect of the present disclosure.

According to several examples of the present disclosure, when the monomer, oligomer or mixture thereof described above is used, from 0.01 to 10 parts by mass of a photopolymerization initiator may be used per 100 parts by mass of the monomer, oligomer or mixture thereof in a preferred aspect of the present disclosure.

In the next step, a composite molded body having a UV curable resin layer is obtained by curing, through irradiation with UV rays, the monomer, oligomer, or mixture thereof contacted with the portion including the roughened structure portion of the rare earth magnet precursor or rare earth magnet molded body.

(5) Method of Manufacturing a Composite Molded Body of Rare Earth Magnet Precursors Having a Roughened Structure or Rare Earth Magnet Molded Bodies Having a Roughened Structure, or a Composite Molded Body of a Rare Earth Magnet Precursor Having a Roughened Structure or a Rare Earth Magnet Molded Body Having a Roughened Structure, and a Rare Earth Magnet Molded Body of a Different Type A composite molded body of rare earth magnet precursors having a roughened structure or rare earth magnet molded bodies having a roughened structure can be manufactured, for example, by using a plurality of rare earth magnet precursors, each having a roughened structure and a different shape, or a plurality of rare earth magnet molded bodies, each having a roughened structure and a different shape, and bonding and integrating these molded bodies through an adhesive layer formed on the bonding surfaces thereof. The adhesive layer can be formed in the same manner as described above by, for example, applying an adhesive to the roughened structure portion of the rare earth magnet precursor or rare earth magnet molded body. The same adhesive used in the manufacturing of the other composite molded body described above can be used as the adhesive.

Furthermore, a composite molded body containing a rare earth magnet precursor or a rare earth magnet molded body, and a rare earth magnet molded body of a different type can be manufactured in the same manner. According to several examples of the present disclosure, in the present embodiment, in addition to manufacturing a composite molded body by a method in which an adhesive layer is formed, in the same manner as described above for example, on the roughened structure portion of a rare earth magnet precursor or rare earth magnet molded body, and then bonded and integrated with a rare earth magnet molded body of a different type, a composite molded body can also by manufactured by forming a roughened structure on also the surface of a rare earth magnet molded body of a different type, and forming, in the same manner as described above for example, an adhesive layer on the roughened structure thereof, and then bonding and integrating a surface of a rare earth magnet precursor or rare earth magnet molded body, the surface thereof having an adhesive layer, with the surface having the adhesive layer of the rare earth magnet molded body of a different type to thereby manufacture the composite molded body.

As a method for roughening the surface of the rare earth magnet molded body of a different type, similar to the present invention, a method of irradiating with a continuous-wave laser beam, a method of irradiating with a pulsed-wave laser beam, or a method of roughening through blasting, etching, or the like can be applied.

Note that the configurations, combinations thereof, and the like in each embodiment of the present disclosure are examples, and various configurational additions, omissions, substitutions, and other changes may be made, as appropriate, without departing from the spirit of the present disclosure. The present disclosure is not limited by the embodiments and is limited only by the claims.

EXAMPLES

Several numeric values measured in the following examples and comparative examples were measured in the following manner.

Rupture Strength (MPa): Stress value at rupture obtained through a bending test.

Arithmetic mean height (Sa) (ISO 25178): Sa in a 3.8×2.8 mm range of the surface of a roughened structured portion of a rare earth magnet precursor was measured using a one-shot 3D shape measuring instrument (available from Keyence Corporation) in a high magnification (80×) camera mode.

Maximum height (Sz) (ISO 25178): Sz in a 3.8×2.8 mm range of the surface of a roughened structured portion of a rare earth magnet precursor was measured using the one-shot 3D shape measuring instrument (available from Keyence Corporation) in a high magnification (80×) camera mode.

Developed interfacial area ratio (Sdr) (ISO 25178): Sdr in a 3.8×2.8 mm range of the surface of a roughened structured portion of a rare earth magnet precursor was measured using the one-shot 3D shape measuring instrument (available from Keyence Corporation) in a high magnification (80×) camera mode.

Root mean square gradient (Sdq) (ISO 25178): A parameter calculated by the root mean square of the slope at all points of a defined area, and the Sdq of a perfectly flat surface is 0. When the surface is inclined, Sdq becomes larger, and for example, Sdq becomes 1 in a plane having an inclination component of 45°. The Sdq was measured using the one-shot 3D shape measuring instrument (available from Keyence Corporation) in a high magnification (80×) camera mode.

(H1, H2)

Ten locations were randomly selected from a range (2 mm×10 mm=20 $mm^2$) of the roughened structure portion of the rare earth magnet precursors obtained in the examples and comparative examples, SEM images of cross-sections of each (cross section with a length of 500 μm or greater in each case) were captured, and the highest and lowest portions were selected from the obtained SEM images to determine, in conjunction with a reference surface, an H1 (the distance from a highest portion bulging higher than the reference surface to a deepest bottom surface section of a groove deeper than the reference surface), and an H2 (the height from the reference surface to the highest leading end of the bulging portion). H2/H1 was expressed as an average value of the ten locations.

Examples 1 to 9 and Comparative Examples 1 to 3

The surface of a raw rare earth magnet molded body of a type shown in Table 1 and the surface of a ferrite magnet molded body (10 mm×50 mm flat plate with a thickness of 4 mm) were roughened by continuously irradiating with a laser beam under the conditions shown in Table 1 using the following continuous-wave laser device.

Oscillator: IPG-Yb fiber; YLR-300-SM or YLR-1000-SM

Galvano mirror: SQUIRREL or RHINO (available from ARGES)

Light focusing system: fc=80 or 110 mm/fθ=163 mm

Note that bi-directional irradiation, unidirectional irradiation, cross irradiation, and the like were implemented as follows.

Bi-directional irradiation: A continuous-wave laser beam was irradiated in a straight line shape to form a single groove in one direction, after which the continuous-wave laser beam was similarly irradiated in a straight line but in an opposite direction at an interval of 0.08 mm or 0.12 mm, and this cycle of irradiation was repeated. The interval (pitch in Table 1) of bi-directional irradiation is the distance between the center positions in the width direction of each of the adjacent grooves.

Unidirectional irradiation: A continuous-wave laser beam was irradiated in a straight line shape to form a single groove in one direction, after which the continuous-wave laser beam was similarly irradiated in a straight line in the same direction at an interval of 0.08 mm or 0.10 mm, and this cycle of irradiation was repeated. The interval (pitch in Table 1) of unidirectional irradiation is the distance between the center positions in the width direction of each of the adjacent grooves.

Cross irradiation: A continuous-wave laser beam was irradiated to form ten grooves (first group of grooves) at intervals of 0.08 mm, after which the continuous-wave laser beam was continuously irradiated to form ten grooves (second group of grooves) at intervals of 0.08 mm in a direction orthogonal to that of the first group of grooves.

Dot irradiation: As illustrated in FIG. 21(*a*), a pulsed-wave laser beam was irradiated to form numerous dots (pores).

Circular irradiation: As illustrated in FIG. 21(*b*), a pulsed-wave laser beam was irradiated to form numerous circles (rings).

Figure 13:
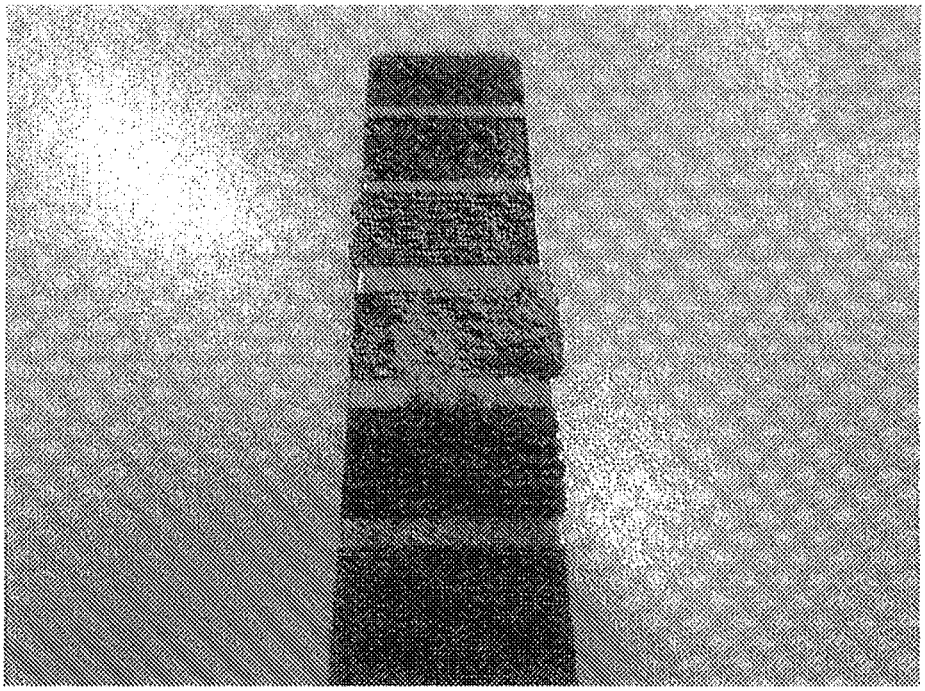
FIG. 13 is a photograph illustrating a rare earth magnet molded body after laser irradiation in Comparative Example 1.
Figure 14:
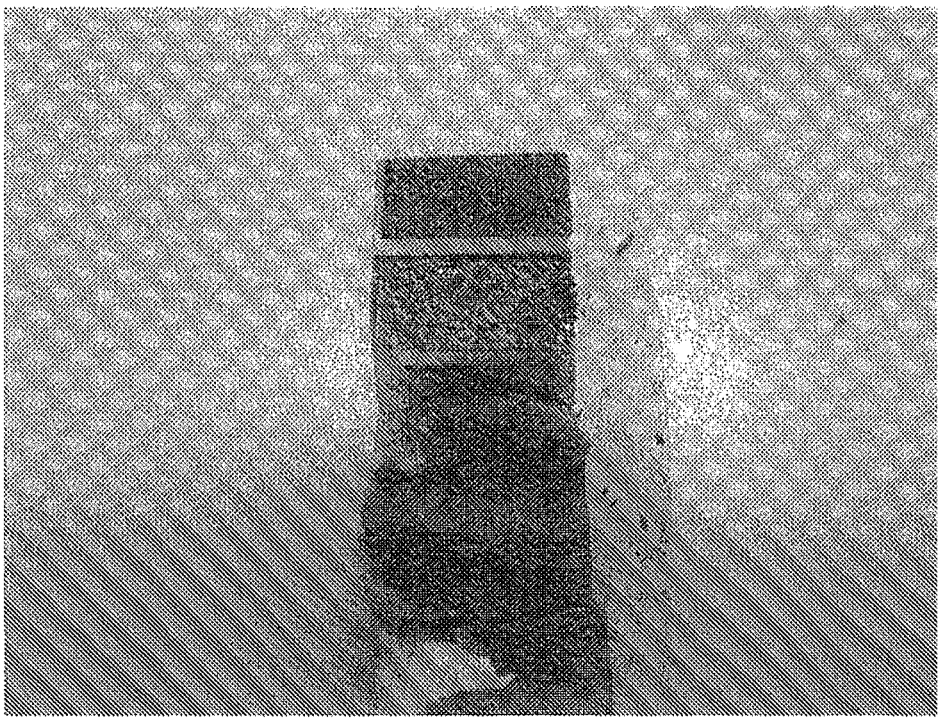
FIG. 14 is a photograph illustrating a laser-irradiated rare earth magnet molded body obtained in Comparative Example 2.

The measurement results of Sa, Sz, and Sdr of the portions having the roughened structure of the rare-earth magnet precursors and ferrite magnet molded bodies of Examples 1 to 9 and Comparative Examples 1 to 3 are shown in Table 1, and SEM images of the surfaces of Examples 1 to 9 are shown in FIGS. 3 to 12. SEM images of cross sections in the thickness direction of Example 2 are shown in FIGS. 4(*a*) and 4(*b*), SEM images of cross sections in the thickness direction of Example 5 are shown in FIGS. 7(*a*) and 7(*b*), and the ordinary photographs of Comparative Examples 1 and 2 are shown in FIGS. 13 and 14.

Furthermore, a composite molded body (FIG. 15) with a resin molded body (molded body of polyamide 6 containing 30 mass % of glass fibers) was manufactured using rare earth magnet molded bodies having a roughened structure and obtained in Examples 2 and 5. This composite molded body was manufactured by inserting a rare earth magnet having a roughened structure into a mold, and in that state, injection molded body polyamide 6 containing 30 mass % of glass fibers under the following conditions.

Injection molding machine: ROBOSHOT S2000i100B

Molding temperature: 280° C.

Mold temperature: 100° C.

The bonding strength between the rare earth magnet molded body and the resin molded body was measured using the obtained composite molded bodies.

[Tensile Test]

Figure 15:
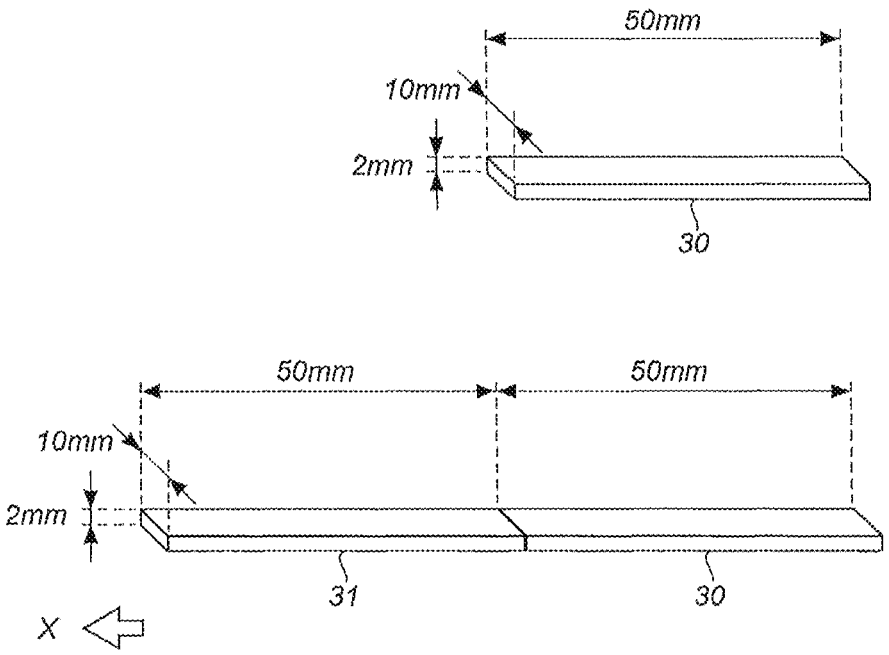
FIG. 15 provides an exemplary perspective view illustrating rare earth magnet molded bodies manufactured in Examples 2 and 5, and a perspective view for explaining a bonding strength test in which a composite molded body according to one example of the present disclosure is used, the composite molded body including a rare earth magnet molded body and a resin molded body.

Using the composite molded body illustrated in FIG. 15, a tensile test was performed to evaluate the shear bonding strength (S1). The results are shown in Table 1. In the tensile test, in accordance with ISO19095, with an end part of a rare earth magnet molded body 30 side fixed, a composite molded body of the rare earth magnet molded body 30 and a resin molded body 31 was pulled in the X direction shown in FIG. 15 until fracturing occurred, and in this case, the maximum load until the bonding surface failed was measured under the following conditions. The results are shown in Table 1.

<Tensile Test Conditions>

Tester: AUTOGRAPH AG-X plus (50 kN), available from Shimadzu Corporation

Tensile Speed: 10 mm/min

Distance between chucks: 50 mm

TABLE 1

| | Examples | | | | | |
|---|---|---|---|---|---|---|
| | 1 | 2 | 3 | 4 | 5 | 6 |
| Rare earth magnet | Neodymium | Neodymium | Neodymium | Neodymium | Samarium cobalt | Samarium cobalt |
| Rupture strength (MPa) | 290 | 290 | 290 | 290 | 150 | 150 |
| irradiation speed (mm/sec) | 10000 | 5000 | 5000 | 10000 | 10000 | 10000 |
| Output (W) | 200 | 281 | 500 | 948 | 200 | 500 |

TABLE 1-continued

| | | | | | | |
|---|---|---|---|---|---|---|
| Energy density (MW/cm$^2$) | 36 | 51 | 148 | 281 | 36 | 148 |
| Number of repetitions (times) | 10 | 10 | 10 | 10 | 5 | 10 |
| Groove width (mm) | 0.02 | 0.03 | | | 0.04 | |
| Pitch (mm) | 0.08 | 0.08 | 0.08 | 0.08 | 0.08 | 0.10 |
| Irradiation form | Bi-directional | Bi-directional | Unidirectional | Unidirectional | Bi-directional | Unidirectional |
| Presence or absence of failure | None | None | None | None | None | None |
| Sa (μm) | 17 | 30 | 135 | 104 | 34 | 42 |
| Sz (μm) | 223 | 355 | 1141 | 790 | 190 | 594 |
| Sdr | 1.5 | 2.4 | 6.6 | 4.4 | 2.4 | 3.2 |
| SEM surface image | FIG. 3(a) | FIG. 4(a) | FIG. 5 | FIG. 6 | FIG. 7(a) | FIG. 8 |
| SEM cross-sectional image | FIG. 3(b) | FIG. 4(b) | | | FIG. 7(b) | |
| H2/H1 | 0.2 | 0.3 | | | 0.6 | |
| Bonding strength MPa | — | 26.3 | — | — | 18.8 | — |

| | Examples | | | Comparative Examples | | |
|---|---|---|---|---|---|---|
| | 7 | 8 | 9 | 1 | 2 | 3 |
| Rare earth magnet | Samarium cobalt | Neodymium | Samarium cobalt | Neodymium | Samarium cobalt | Ferrite |
| Rupture strength (MPa) | 150 | 290 | 150 | 290 | 150 | 70 |
| irradiation speed (mm/sec) | 10000 | 10000 | 10000 | 2500 | 2500 | 10000 |
| Output (W) | 948 | 285 | 200 | 200 | 200 | 200 |
| Energy density (MW/cm$^2$) | 281 | 52 | 36 | 51 | 51 | 51 |
| Number of repetitions (times) | 10 | 10 | 10 | 10 | 10 | 10 |
| Groove width (mm) | | | | | | |
| Pitch (mm) | 0.10 | 0.08 | 0.08 | 0.08 | 0.08 | 0.08 |
| Irradiation form | Unidirectional | Cross | Cross | Bi-directional | Bi-directional | Bi-directional |
| Presence or absence of failure | None | None | None | Present | Present | Present |
| Sa (μm) | 61 | 18 | 19 | — | — | — |
| Sz (μm) | 497 | 243 | 160 | — | — | — |
| Sdr | 1.7 | 1.0 | 1.1 | — | — | — |
| SEM surface image | FIG. 9 | FIG. 10 | FIG. 11 | FIG. 13 | FIG. 14 | — |
| SEM cross-sectional image | | | | | | |
| H2/H1 | | | | | | |
| Bonding strength MPa | — | — | — | — | — | — |

As is clear from the SEM images of FIGS. 3 to 9 of the roughened structures obtained through bi-directional or uni-directional irradiation, roughened structures satisfying the requirements of (a) to (c) were formed on the rare earth magnet precursors of Examples 1 to 7.

The roughened structure of Example 1 (FIG. 3(*a*) to (*c*)) included the following cross-sectional structure. Namely, when a surface on which the roughened structure was not formed was used as a reference surface, the cross-sectional shape in the thickness direction included an intermingling of portions bulging further upward than the reference surface and portions where a groove was formed. H1/H2 was 0.2.

At least some of the bulging portions had a portion where a part of the leading end was deformed into a hook shape, and a portion where a part of the leading end was deformed into a ring shape was an incomplete ring. Furthermore, at least some of the grooves had an inner bridge portion (circled portions in FIG. 3(*b*)) in which opposing inner wall surfaces of the grooves were connected.

The roughened structure of Example 2 (FIG. 4(*a*) to (*c*)) included the following cross-sectional structure. Namely, when a surface on which the roughened structure was not formed was used as a reference surface, the cross-sectional shape in the thickness direction included an intermingling of portions bulging further upward than the reference surface and portions where a groove was formed. H1/H2 was 0.3.

At least some of the bulging portions had a portion where a part of the leading end was deformed into a hook shape and a portion where a part of the leading end was deformed into a ring shape. Furthermore, at least some of the grooves had an inner bridge portion (corresponding to the circled portions in FIG. 3(*b*)) in which opposing inner wall surfaces of the grooves were connected.

The roughened structure of Example 5 (FIG. 7(*a*) to (*c*)) included the following cross-sectional structure. Namely, when a surface on which the roughened structure was not formed was used as a reference surface, the cross-sectional shape in the thickness direction included an intermingling of portions bulging further upward than the reference surface and portions where a groove was formed. H1/H2 was 0.6.

At least some of the bulging portions had a portion where a part of the leading end was deformed into a hook shape and a portion where a part of the leading end was deformed into a ring shape. Furthermore, the cross-sectional shape of the bottom surface of the groove was a curved surface.

As is clear from the SEM images of FIGS. 10 and 11 of the roughened structures obtained through cross irradiation, roughened structures satisfying the requirements of (a') to (c') were formed on the rare earth magnet molded bodies of Examples 8 and 9. Namely, the recesses and protrusions of the roughened structures formed through cross irradiation with a laser beam in Example 8 (FIG. 10) and Example 9 (FIG. 11) included lattice-shaped grooves and numerous islands surrounded by the lattice-shaped grooves.

In Example 8 (FIG. 10), bridge portions bridged between some islands were formed. In Example 9 (FIG. 11), bridge portions bridged between some islands were formed, and the ratio (ratio per unit area) of bridge portions was greater than that of Example 8 (FIG. 10).

As is clear from Table 1, composite molded bodies with high bonding strength could be obtained using the resin molded bodies and rare earth magnet precursors with formed roughened structures of Examples 2 and 5.

As can be confirmed from also FIGS. 13 and 14, in Comparative Examples 1 to 3, a portion of the test piece fractured (presence of failure as noted in Table 1) when irradiated with a continuous-wave laser beam.

Examples 10 to 13 and Comparative Example 4

The surface of a raw rare earth magnet molded body (10 mm×50 mm flat plate with a thickness of 4 mm) of a type shown in Table 2 was roughened by continuously irradiating a laser beam under the conditions shown in Table 2 using the same continuous-wave laser device as that of Example 1.

The rare earth magnet precursor having a roughened structure and obtained in Example 13 was subjected to a magnetization treatment with the method and conditions described below. After the magnetization treatment, it was confirmed that each had a magnetic force that was due to the iron member.

Furthermore, the magnetic force of the magnetized rare earth magnet molded body having a roughened structure was measured. Additionally, the magnetic force of the rare earth magnet molded body not subjected to the roughening treatment was also measured, and the magnetic force retention rate (%) was determined from the following equation.

Magnetic force retention rate (%)=(Magnetic force ($mT2$) of rare earth magnet molded body with roughened structure)/(Magnetic force ($mT1$) of rare earth magnet molded body without roughened structure formed thereon)×100

<Magnetization Treatment Method>

A known magnetization method using a magnetizing coil was implemented.

A capacitor-type magnetization power supply (pulse-type power supply) that instantaneously discharges an electric charge stored in a charged capacitor was used to magnetize a magnetization subject by passing a large electric current through the magnetizing coil with the magnetization subject placed in the magnetizing coil.

(Method for Measuring Magnetic Force)

A sample was placed on a plate containing a Hall element that detects magnetic force, and the magnetic force (mT) was determined using a Gauss meter (HGM-8300 series; available from ADS, Inc.) and a personal computer.

Figure 16:
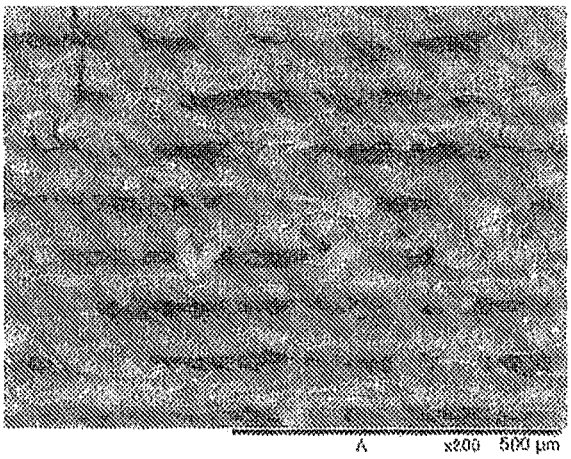
FIG. 16(*a*) is an SEM image of a surface of a rare earth magnet molded body having a roughened structure and obtained in Example 10.
Figure 16:
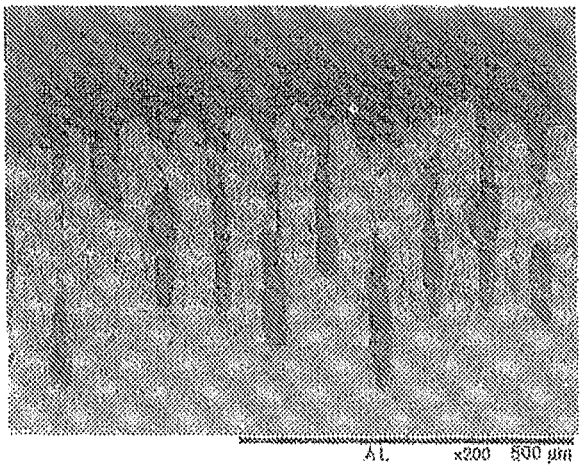
Figure 16:
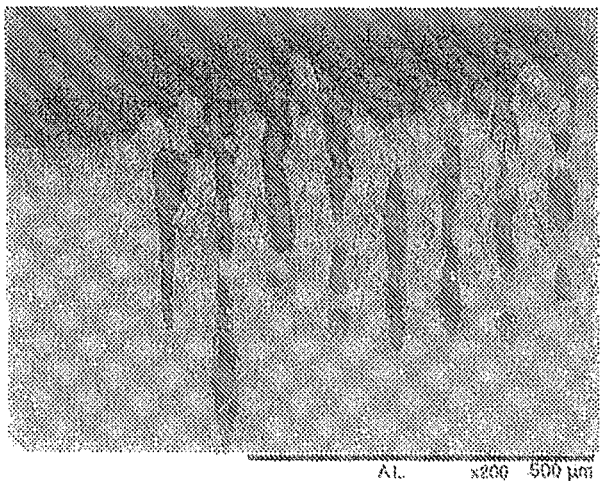

The roughened structure of Example 10 (FIGS. 16(*a*) to (*c*)) included the following cross-sectional structure. Namely, when a surface on which the roughened structure was not formed was used as a reference surface, the cross-sectional shape in the thickness direction included an intermingling of portions bulging further upward than the reference surface and portions where a groove was formed. H1/H2 was 0.2.

At least some of the bulging portions had a portion where a part of the leading end was deformed into a ring shape. Furthermore, at least some of the grooves had an inner bridge portion (corresponding to the circled portions in FIG. 3(*b*)) in which opposing inner wall surfaces of the grooves were connected.

Figure 17:
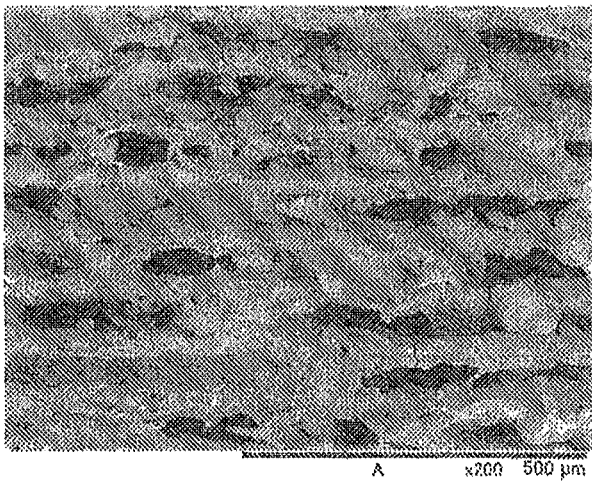
FIG. 17(*a*) is an SEM image of a surface of a rare earth magnet molded body having a roughened structure and obtained in Example 11, FIG. 17(*b*) is an SEM image of a cross-section in the thickness direction orthogonal to the direction of formation of the linear protrusions and linear recesses in FIG. 17(*a*), and FIG. 17(*c*) is an SEM image for explaining the relationship between the non-roughened structure surface and the roughened structure surface in FIG. 17(*b*).
Figure 17:
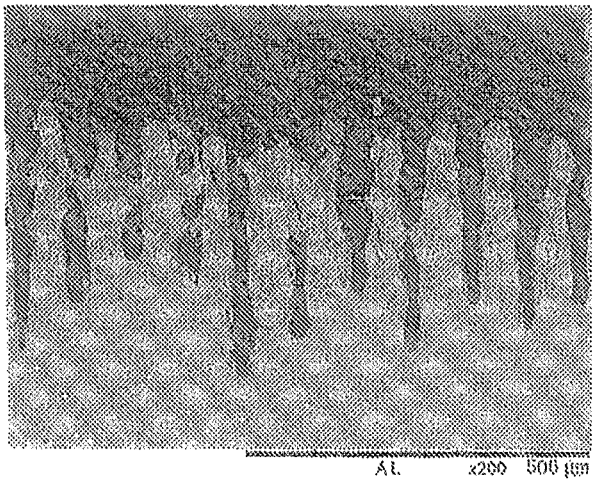
Figure 17:
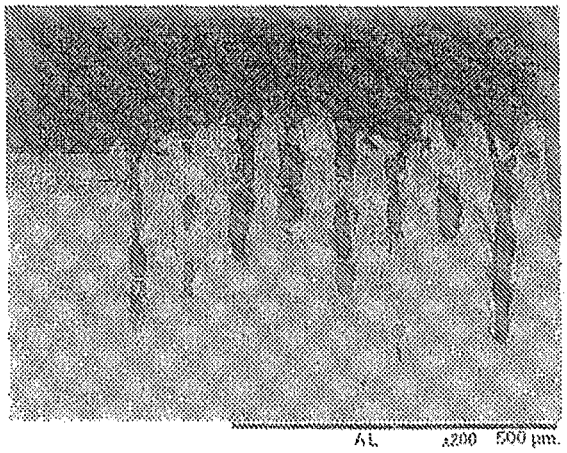

The roughened structure of Example 11 (FIGS. 17(*a*) to (*c*)) included the following cross-sectional structure. Namely, when a surface on which the roughened structure was not formed was used as a reference surface, the cross-sectional shape in the thickness direction included an intermingling of portions bulging further upward than the reference surface and portions where a groove was formed. H1/H2 was 0.2.

At least some of the bulging portions had a portion where a part of the leading end was deformed into a ring shape. Furthermore, at least some of the grooves had an inner bridge portion (corresponding to the circled portions in FIG. 3(*b*)) in which opposing inner wall surfaces of the grooves were connected.

Figure 18:
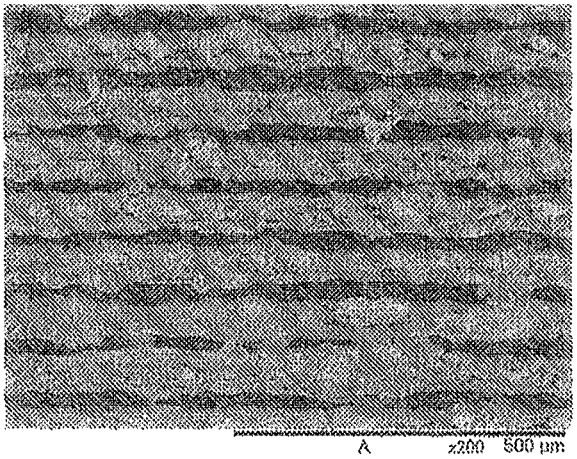
FIG. 18(*a*) is an SEM image of a surface of a rare earth magnet molded body having a roughened structure and obtained in Example 12, FIG. 18(*b*) is an SEM image of a cross-section in the thickness direction orthogonal to the direction of formation of the linear protrusions and linear recesses of FIG. 18(*a*), and FIG. 18(*c*) is an SEM image for explaining the relationship between the non-roughened structure surface and the roughened structure surface in FIG. 18(*b*).
Figure 18:
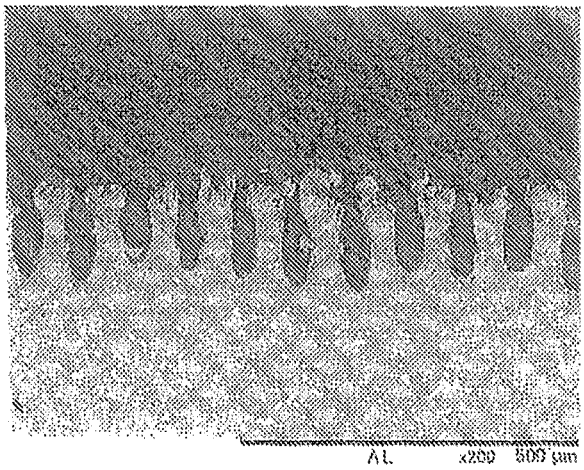
Figure 18:
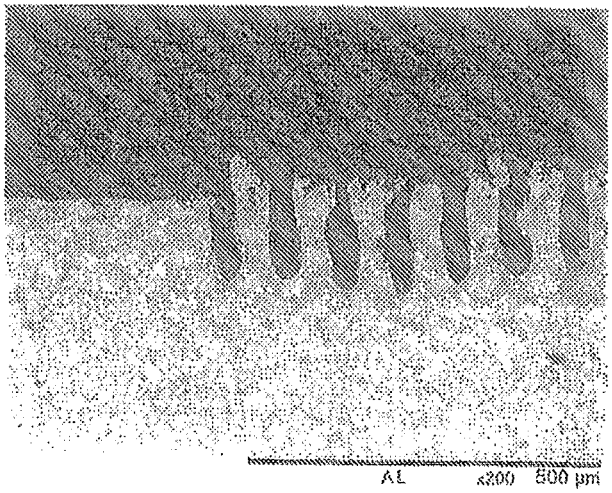

The roughened structure of Example 12 (FIGS. 18(*a*) to (*c*)) included the following cross-sectional structure. Namely, when a surface on which the roughened structure was not formed was used as a reference surface, the cross-sectional shape in the thickness direction included an intermingling of portions bulging further upward than the reference surface and portions where a groove was formed. H1/H2 was 0.3.

At least some of the bulging portions had a portion where a part of the leading end was deformed into a hook shape and a portion where a part of the leading end was deformed into

TABLE 2

Figure 19:
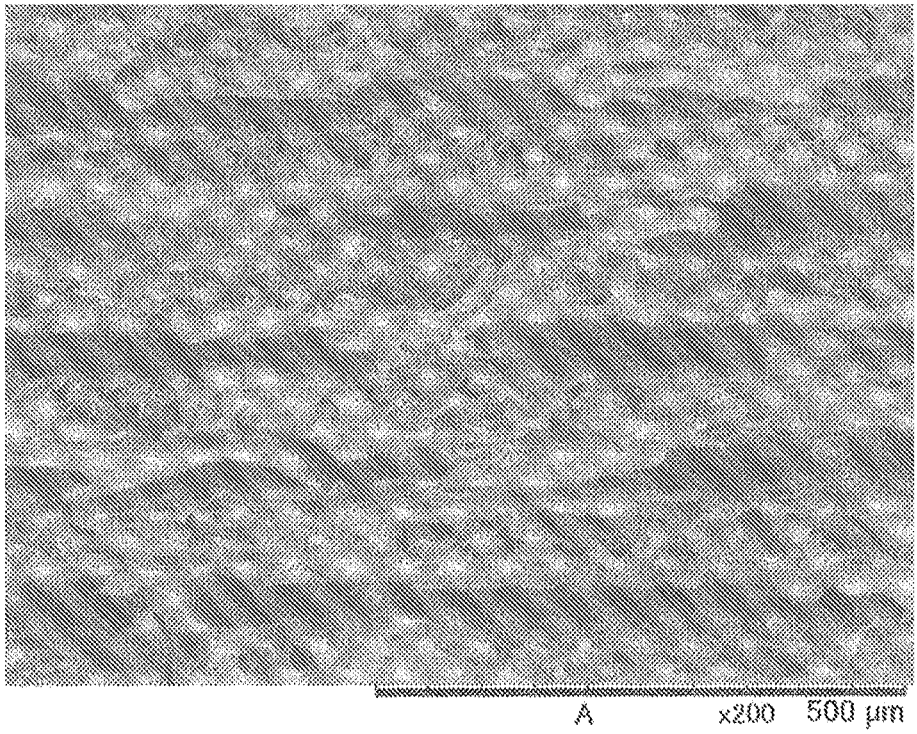
FIG. 19 is an SEM image of a surface of a rare earth magnet molded body having a roughened structure and obtained in Example 13.

| | Examples | | | | Comparative Example |
|---|---|---|---|---|---|
| | 10 | 11 | 12 | 13 | 4 |
| Rare earth magnet | Neodymium | Neodymium | Samarium cobalt | Neodymium | Neodymium |
| Rupture strength (MPa) | 290 | 290 | 150 | 290 | 290 |
| Irradiation speed (mm/sec) | 5000 | 5000 | 10000 | 5000 | 2500 |
| Output (W) | 281 | 281 | 281 | 300 | 281 |
| Energy density ($MW/cm^2$) | 51 | 51 | 51 | 89 | 51 |
| Number of repetitions (times) | 10 | 5 | 5 | 10 | 10 |
| Pitch (mm) | 0.08 | 0.08 | 0.08 | 0.12 | 0.08 |
| Irradiation form | Bi-directional | Bi-directional | Bi-directional | Bi-directional | Bi-directional |
| Presence or absence of failure | None | None | None | None | Present |
| Sa (μm) | 32 | 28 | 41 | 27 | — |
| Sz (μm) | 608 | 421 | 258 | 492 | — |
| Sdr | 2.4 | 2.4 | 3.4 | 1.5 | — |
| SEM surface image | FIG. 16(a) | FIG. 17(a) | FIG. 18(a) | FIG. 19 | FIG. 20(a) |
| SEM cross-sectional image | FIG. 16(b) | FIG. 17(b) | FIG. 18(b) | — | FIG. 20(b) |
| H2/H1 | 0.2 | 0.2 | 0.3 | — | 0.2 |
| Magnetic force retention rate (%) | — | — | — | 95 | — |

a ring shape. Furthermore, at least some of the grooves had an inner bridge portion (corresponding to the circled portions in FIG. 3(*b*)) in which opposing inner wall surfaces of the grooves were connected.

Figure 20:
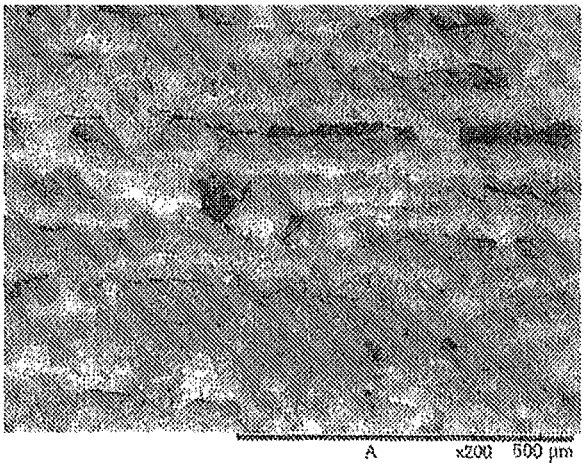
FIG. 20(*a*) is an SEM image of a surface of a rare earth magnet molded body having a roughened structure and obtained in Comparative Example 4, FIG. 20(*b*) is an SEM image of a cross-section in the thickness direction orthogonal to the direction of formation of the linear protrusions and linear recesses in FIG. 20(*a*), and FIG. 20(*c*) is an SEM image for explaining the relationship between the non-roughened structure surface and the roughened structure surface in FIG. 20(*b*).
Figure 20:
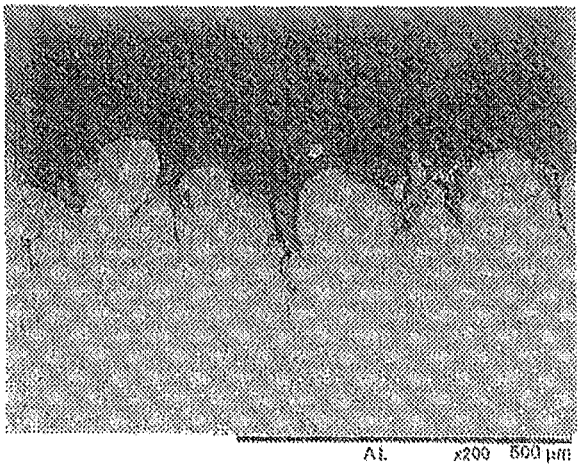
Figure 20:
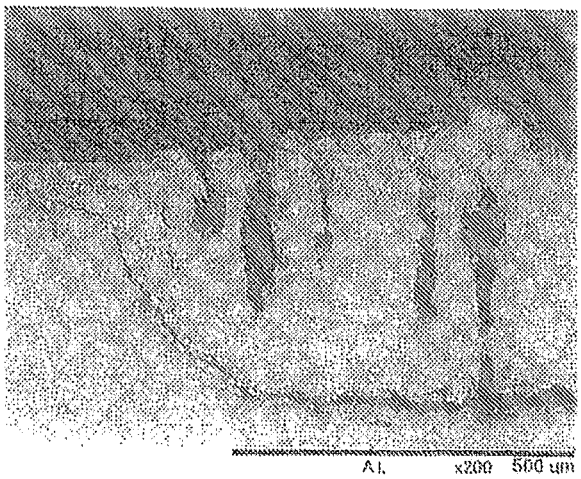

The roughened structure of Comparative Example 4 (FIGS. 20(*a*) to (*c*)) was significantly collapsed compared to the roughened structures of Example 11 to 13, and a portion of the test piece fractured (presence of failure as noted in Table 2).

Examples 14 to 19

The surface of a raw rare earth magnet molded body of a type shown in Table 3 and the surface of a ferrite magnet molded body (10 mm×50 mm flat plate with a thickness of 4 mm) were roughened by irradiating a pulsed-waved laser beam under the conditions shown in Table 3 using the following laser device.

Oscillator: IPG-Yb-Fiber Laser; YLP-1-50-30-30-Ra

Galvano mirror: XD30+Hurry SCAN10 available from Scanlab GmbH

Light focusing system: Beam expander 2X/fθ=100 mm

Subsequently, as in Example 1, a composite molded body (FIG. 16) of a rare earth magnet molded body having a roughened structure and a resin molded body (molded body of polyamide 6 containing 30 mass % of glass fibers) was manufactured. In the same manner as Example 1, the bonding strength between the rare earth magnet molded body and the resin molded body was measured using the obtained composite molded bodies.

In Example 16 (FIG. 24), circular recesses and annular protrusions were formed, and a hook-shaped projecting part was formed in the circular recess from the inside of the annular protrusion. In addition, Example 16 also had a recess surrounded by four adjacent annular protrusions.

In Example 17 (FIG. 25), adjacent annular protrusions were independent, but Example 17 had numerous projections projected outward from the outer circumferential wall section. Some of the projections of adjacent annular protrusions were mutually contacting, and some of the projections of adjacent annular protrusions were mutually connected.

Figure 26:
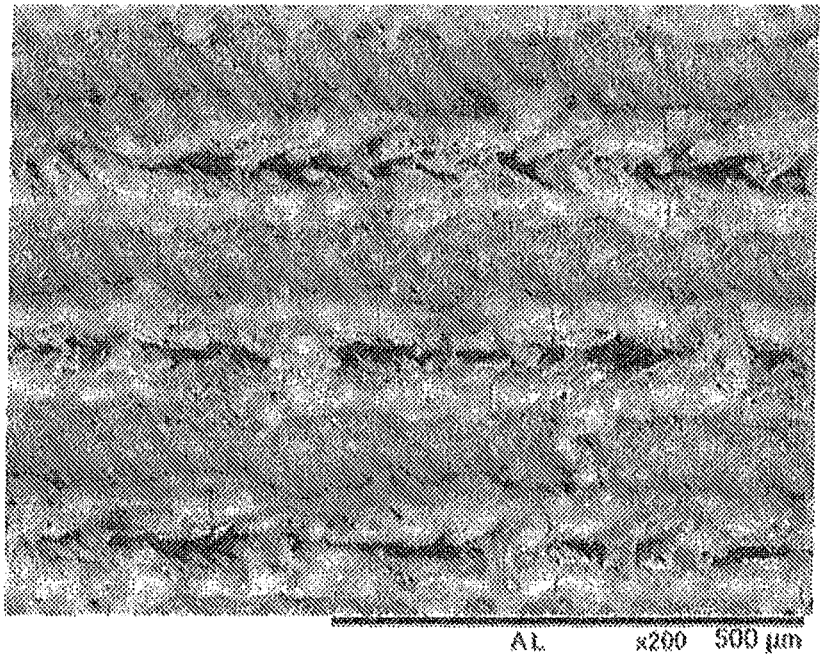
FIG. 26(*a*) is an SEM image of a surface of a rare earth magnet molded body having a roughened structure and obtained in Example 18, and FIG. 26(*b*) is a cross-sectional view in the thickness direction of FIG. 26(*a*).
Figure 26:
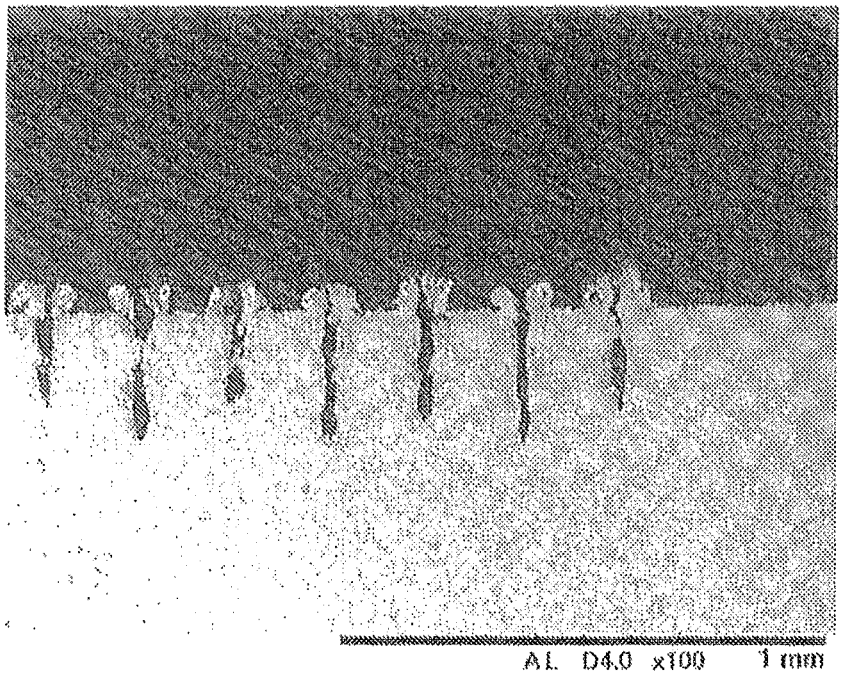

Example 18 (FIG. 26) was a roughened structure similar to Example 14.

In Example 19 (FIG. 27), the number of repetitions was as few as one, and the groove depth in one direction was shallow, and therefore a distinct island was not formed. As a result, Example 19 contained a structure of a mixture of portions of discontinuous linear recesses and portions of discontinuous linear protrusions.

INDUSTRIAL APPLICABILITY

A rare earth magnet precursor or rare earth magnet molded body according to the present disclosure with a roughened structure on the surface can be magnetized and used as is as a permanent magnet, and can also be used as a manufacturing intermediate for a composite molded body of the rare earth magnet molded body and a resin, rubber, elastomer, metal, or the like.

TABLE 3

Figure 22:
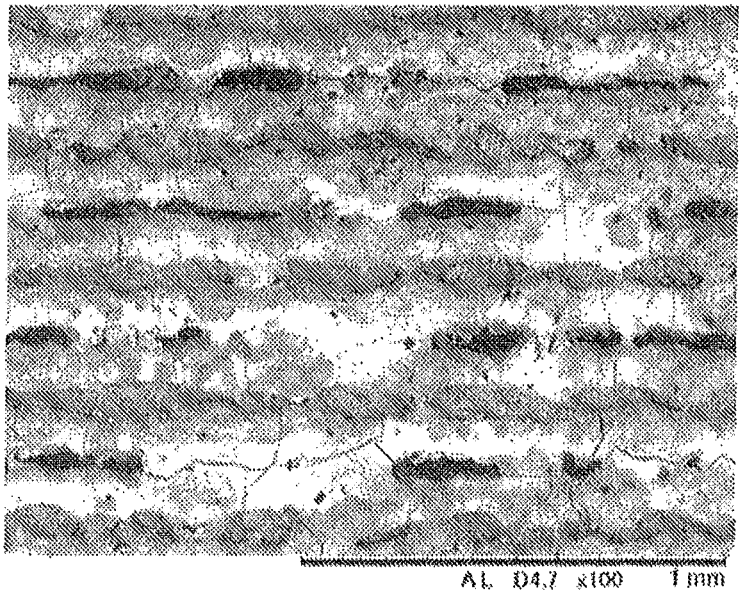
FIG. 22 is an SEM image of a surface of a rare earth magnet molded body having a roughened structure and obtained in Example 14.
Figure 23:
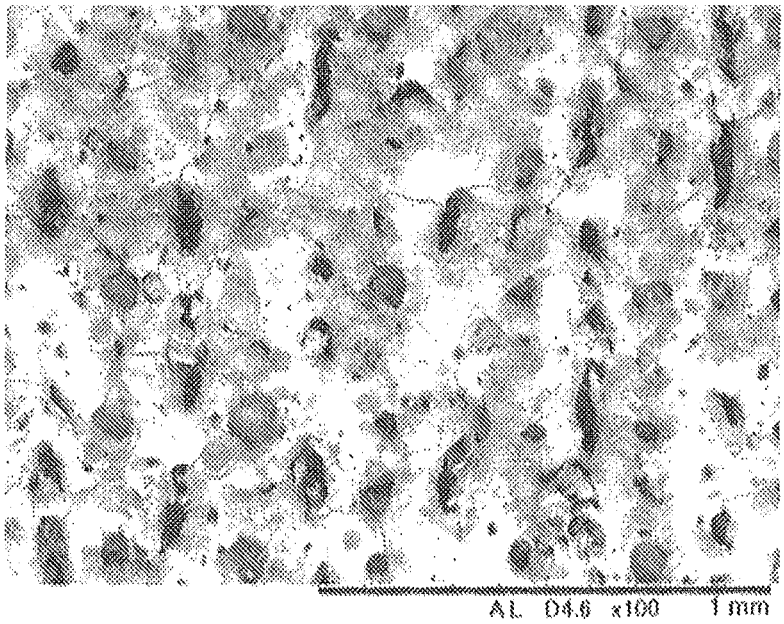
FIG. 23 is an SEM image of a surface of a rare earth magnet molded body having a roughened structure and obtained in Example 15.

| | Examples | | | | | |
|---|---|---|---|---|---|---|
| | 14 | 15 | 16 | 17 | 18 | 19 |
| Rare earth magnet | Neodymium | Neodymium | Neodymium | Neodymium | Samarium cobalt | Samarium cobalt |
| Rupture strength (MPa) | 290 | 290 | 290 | 290 | 150 | 150 |
| Output (W) | 30 | 30 | 30 | 30 | 15 | 15 |
| Spot diameter (μm) | 32 | 32 | 32 | 32 | 32 | 32 |
| Frequency (kHz) | 30 | 30 | 30 | 30 | 30 | 30 |
| Pulse width (nsec) | 50 | 50 | 50 | 50 | 50 | 50 |
| Irradiation form | Bi-directional | Cross | Circle | Dots | Bi-directional | Cross |
| (i) Irradiation angle (degrees) | 90 | 90 | 90 | 90 | 90 | 90 |
| (ii) Irradiation speed (mm/sec) | 50 | 50 | 800 | — | 50 | 50 |
| (iii) Energy Density (GW/cm$^2$) | 2.49 | 2.49 | 2.49 | 2.49 | 1.25 | 1.25 |
| (iv) Number of repetitions (times) | 15 | Vertical 10, horizontal 10 | 1 | 1 | 5 | Vertical 1, horizontal 1 |
| (v) Pitch (mm) | 0.2 | 0.3 | 0.3 | 0.2 | 0.2 | 0.2 |
| H1 | — | — | 217 | — | 347 | 194 |
| H2 | — | — | 116 | — | 69 | 97 |
| H2/H1 | — | — | 0.53 | — | 0.20 | 0.20 |
| Sa (μm) | 34 | 20 | 46 | 23 | 23 | 11 |
| Sz (μm) | 422 | 277 | 401 | 168 | 178 | 155 |
| Sdr | 1.34 | 0.68 | 2.62 | 0.85 | 0.49 | 0.39 |
| Sdq | 2.13 | 1.34 | 2.75 | 1.51 | 1.21 | 0.97 |
| SEM surface image | FIG. 22 | FIG. 23 | FIG. 24(a) | FIG. 25 | FIG. 26(a) | FIG. 27(a) |
| SEM cross-sectional image | — | — | FIG. 24(b) | — | FIG. 26(b) | FIG. 27(b) |
| Tensile strength | 18 | 16 | 23 | 13 | 15 | 11 |

In Example 14 (FIG. 22), linear recesses and linear protrusions were alternately formed, but some of the linear recesses included discontinuous portions where adjacent protrusions were integrated and formed a lid (outer bridge portion).

In Example 15 (FIG. 23), the grooves (linear grooves) became discontinuous, numerous independent recesses were present, and the periphery of the recesses became a protrusion.

The invention claimed is:

1. A rare earth magnet material having a roughened structure on a surface, wherein the surface having the roughened structure comprises a plurality of protrusion regions formed in a length direction and a plurality of recess regions formed in the same direction as the length direction, and the protrusion regions and the recess region are alternately formed in a direction orthogonal to the length direction at the same or different intervals, wherein the intervals between widthwise center positions of the plurality of protrusion regions or the intervals between widthwise center positions of the plurality of recess regions are in a range from 0.03 to 1.0 mm, and wherein recesses and protrusions satisfying at least one of the following requirements (a) to (c) are formed in the surface having the roughened structure:

(a) an arithmetic mean height (Sa) (ISO 25178) from 5 to 300 μm, (b) a maximum height (Sz) (ISO 25178) from 50 to 1500 μm, and (c) a developed interfacial area ratio (Sdr) (ISO 25178) from 0.3 to 12.

2. The rare earth magnet material according to claim 1, wherein the surface having the roughened structure comprises at least one of (i) a portion at which protrusion regions adjacent in the direction orthogonal to the length direction are deformed in a hook shape so as to be close to each other and (ii) an outer bridge portion at which protrusion regions adjacent in the direction orthogonal to the length direction are mutually cross-linked.

3. The rare earth magnet material according to claim 1, wherein the plurality of recess regions and the plurality of protrusion regions formed intermingled in a length direction, and a plurality of rows of the plurality of recess regions and the plurality of protrusion regions formed intermingled in the length direction are formed in a direction orthogonal to the length direction.

4. The rare earth magnet material according to claim 1, wherein the protrusion regions are linear protrusions and the recess regions are linear recesses.

5. The rare earth magnet material according to claim 1, wherein the rare earth magnet material is an unmagnetized rare earth magnet precursor.

6. The rare earth magnet material according to claim 1, wherein the intervals are in a range from 0.03 to 0.2 mm.

7. The rare earth magnet material according to claim 1, wherein, provided that a surface not formed with the roughened structure is a reference surface, a portion that bulges above the reference surface and a groove portion that is deeper than the reference surface are formed intermingled in the surface having the roughened structure in a thickness-wise cross-section, and a ratio (H2/H1) of a height (H2) of a highest leading edge of the bulge portion from the reference surface to a distance (H1) from the highest leading edge of the bulge portion to a deepest bottom surface of the groove portion is in a range from 0.1 to 0.7.

8. The rare earth magnet material according to claim 7, wherein at least part of the bulge portion comprises at least one of a portion at which part of the leading edge is deformed in a hook shape or a portion at which part of the leading edge is deformed in a ring shape, at least part of the groove portion comprises an inner bridge portion in which opposing inner wall surfaces of the groove portion are connected, and a cross-sectional shape of the bottom surface is a curved surface.

9. The rare earth magnet material according to claim 1, wherein the arithmetic mean height (Sa) of the requirement (a) is from 5 to 200 μm, the maximum height (Sz) of the requirement (b) is from 150 to 1300 μm, and the developed interfacial area ratio (Sdr) of the requirement (c) is from 0.3 to 10.

10. The rare earth magnet material according to claim 1, wherein the arithmetic mean height (Sa) of the requirement (a) is from 10 to 150 μm, the maximum height (Sz) of the requirement (b) is from 200 to 1200 μm, and the developed interfacial area ratio (Sdr) of the requirement (c) is from 0.3 to 8.

11. The rare earth magnet material according to claim 1, wherein the rare earth magnet material has a rupture strength of 80 MPa or greater before the roughened structure is formed on the surface, and a thickness of a portion forming the roughened structure is 0.5 mm or greater.

12. The rare earth magnet material according to claim 1, wherein the surface having the roughened structure includes a molded body selected from a thermoplastic resin, a thermoplastic elastomer, a rubber, a thermosetting resin, a UV curable resin, a metal and a rare earth magnet material of a type different from the rare earth magnet material, part of the molded body being directly entered into the recesses and protrusions of the roughened structure to join and integrate the molded body with the rare earth magnet material.

13. The rare earth magnet material according to claim 1, wherein the surface having the roughened structure includes a molded body selected from a thermoplastic resin, a thermoplastic elastomer, a rubber, a thermosetting resin, a UV curable resin, a metal and a rare earth magnet material of a type different from the rare earth magnet material, part of the molded body being joined and integrated with the rare earth magnet material through an adhesive entered into the recesses and protrusions of the roughened structure.

14. A rare earth magnet material having a roughened structure on a surface, wherein the surface having the roughened structure comprises a plurality of circular recesses, a plurality of annular protrusions formed around the plurality of circular recesses, and recesses surrounded by adjacent ones of the plurality of annular protrusions, and all or some of the annular protrusions have a hook-shaped projecting part projected into the inner circular recess and/or a plurality of projections projecting outward from outer circumferential wall sections thereof, and wherein recesses and protrusions satisfying at least one of the following requirements (a) to (c) are formed in the surface having the roughened structure:

(a) an arithmetic mean height (Sa) (ISO 25178) from 5 to 300 μm, (b) a maximum height (Sz) (ISO 25178) from 50 to 1500 μm, and (c) a developed interfacial area ratio (Sdr) (ISO 25178) from 0.3 to 12.

15. The rare earth magnet material according to claim 14, wherein the rare earth magnet material is an unmagnetized rare earth magnet precursor.

16. A rare earth magnet material having a roughened structure in a surface, wherein the surface having the roughened structure comprises a plurality of independent protrusions each surrounded by a recess or a plurality of independent recesses and a protrusion surrounding each recess, wherein the plurality of independent protrusions or the plurality of independent recesses comprise a first group of linear protrusions and linear recesses in which a plurality of linear protrusions formed in a length direction and a plurality of linear recesses formed in the same direction as the length direction are alternately formed in a direction orthogonal to the length direction at the same or different intervals and a second group of a plurality of linear protrusions and a plurality of linear recesses alternately formed at the same or different intervals in a direction to intersect the first group of linear protrusions and linear recesses, wherein the intervals between widthwise center positions of the linear protrusions in the first group and the intervals between widthwise center positions of the linear recesses in the first group, and the intervals between widthwise center positions of the linear protrusions in the second group and the intervals between widthwise center positions of the linear recesses in the second group are in a range from 0.03 to 1.0 mm, and wherein recesses and protrusions satisfying at least one of the following requirements (a') to (c') are formed:

(a') an arithmetic mean height (Sa) (ISO 25178) from 5 to 150 μm, (b') a maximum height (Sz) (ISO 25178) from 50 to 700 μm, and (c') a developed interfacial area ratio (Sdr) (ISO 25178) from 0.3 to 6.

17. The rare earth magnet material according to claim 16, wherein the rare earth magnet material is an unmagnetized rare earth magnet precursor.

18. The rare earth magnet material according to claim 16, wherein the intervals are in a range from 0.03 to 0.2 mm.

19. The rare earth magnet material according to claim 16, wherein the arithmetic mean height (Sa) of the requirement (a') is from 5 to 100 μm, the maximum height (Sz) of the requirement (b') is from 100 to 600 μm, and the developed interfacial area ratio (Sdr) of the requirement (c') is from 0.3 to 5.

20. The rare earth magnet material according to claim 16, wherein the arithmetic mean height (Sa) of the requirement (a') is from 10 to 50 μm, the maximum height (Sz) of the requirement (b') is from 120 to 500 μm, and the developed interfacial area ratio (Sdr) of the requirement (c') is from 0.35 to 4.

* * * * *